US007856685B2

(12) United States Patent
Matunaga et al.

(10) Patent No.: US 7,856,685 B2
(45) Date of Patent: Dec. 28, 2010

(54) STRETCHER

(75) Inventors: Sigeyuki Matunaga, Gifu (JP); Noriyuki Matunaga, Gifu (JP); Kazuyuki Goto, Gifu (JP)

(73) Assignee: Matunaga Manufactory Co., Ltd., Gifu (JP)

( * ) Notice: Subject to any disclaimer, the term of this patent is extended or adjusted under 35 U.S.C. 154(b) by 218 days.

(21) Appl. No.: 10/547,812

(22) PCT Filed: Feb. 27, 2004

(86) PCT No.: PCT/JP2004/002423

§ 371 (c)(1),
(2), (4) Date: Mar. 6, 2006

(87) PCT Pub. No.: WO2004/078087

PCT Pub. Date: Sep. 16, 2004

(65) Prior Publication Data

US 2006/0207027 A1 Sep. 21, 2006

(30) Foreign Application Priority Data

Mar. 3, 2003 (JP) ..... 2003-055585
Nov. 17, 2003 (JP) ..... 2003-386299

(51) Int. Cl.
*A61G 1/02* (2006.01)

(52) U.S. Cl. ..... 5/611; 5/11; 5/86.1; 296/20

(58) Field of Classification Search ..... 5/611, 5/625–627, 86.1, 11; 296/20, 19
See application file for complete search history.

(56) References Cited

U.S. PATENT DOCUMENTS

| | | | | | |
|---|---|---|---|---|---|
| 1,947,524 | A | * | 2/1934 | Horldt | 16/85 |
| 3,826,528 | A | * | 7/1974 | East | 296/20 |
| 4,921,295 | A | * | 5/1990 | Stollenwerk | 296/20 |
| 5,432,966 | A | * | 7/1995 | Berta et al. | 5/611 |
| 5,509,159 | A | * | 4/1996 | Du-Bois | 5/627 |
| 5,537,700 | A | * | 7/1996 | Way et al. | 5/611 |
| 5,575,026 | A | * | 11/1996 | Way et al. | 5/617 |

FOREIGN PATENT DOCUMENTS

| | | | |
|---|---|---|---|
| WO | WO 94/15566 | A2 | 7/1994 |
| WO | WO 01/70161 | A1 | 9/2001 |
| WO | WO 02/39944 | A2 | 5/2002 |
| WO | WO 02/051347 | A1 | 7/2002 |

* cited by examiner

*Primary Examiner*—Michael Trettel
*Assistant Examiner*—William Kelleher
(74) *Attorney, Agent, or Firm*—Adams Intellectual Property Law

(57) ABSTRACT

A stretcher (100) has casters on front legs (15) and rear legs (17), an upper frame (11) on the upper part of which a stretcher body is placed, constant load springs (28,29) in a slide mechanism for vertically varying the position of the upper frame (11), and mechanical locking devices (32,33) for stopping the upper frame at desired positions. The stretcher (100) further has a lock mechanism (31) for locking front leg-assisting frames (16), for supporting the front legs, so as not to slide, and has rear leg-assisting frames (18) for supporting the front legs (15), the front leg-assisting frames (16), and the rear legs (17).

12 Claims, 24 Drawing Sheets

STRETCHER

TECHNICAL FIELD

This is a national phase application of International Application PCT/JP04/002423, filed Feb. 27, 2004, and claims priority to Japanese Patent Application No. 2003-055585, filed Mar. 3, 2003 and Japanese Patent Application No. 2003-386299, filed Nov. 17, 2003. The present invention relates to a stretcher used for carrying an emergency patient or sick person, which is capable of swiftly and stably placing and securing a litter with an emergency patient or sick person thereon, and a litter which is placed on the stretcher.

BACKGROUND ART

In a stretcher, which is loaded on an ambulance car for carrying an emergency patient, the front and rear leg sections of the stretcher are folded and loaded onto the ambulance car. Particularly, in the matter of urgency, the leg sections are required to have such folding structure that allows the stretcher to be readily loaded onto the ambulance car and unloaded therefrom. Further, since the stretcher is used for carrying a patient with an advanced disease or an emergency patient, the leg sections of the stretcher are required to have a structure such that, when the stretcher is loaded onto the ambulance car, the folding structure functions gently so as not to give any pain or uneasiness to the patient. Further, it is conceivable that the loading and unloading work of the emergency patient is carried out in a various situation. Therefore, such a slide mechanism capable of swiftly adjusting the height of the stretcher table of the stretcher to an appropriate position is also required.

Conventionally, as for a sliding system for raising and lowering the stretcher table of the stretcher, an oil spring type with lock, in which a pin is engaged with a hole to lock the stretcher table of the stretcher at a desired height, is employed. The above system has the following disadvantage. That is, the positions for adjusting and securing the height are limited to the positions formed with holes. Therefore, in order to reduce the distance for loading a patient onto a stretcher table of the stretcher as short as possible, various methods for adjusting the height of the stretcher table in a stepless manner has been proposed.

Patent document 1 discloses the following stretcher in a claim. That is, "a stretcher having castors on the front portion and the rear portion, comprising: an upper frame for loading a litter on its upper portion and a slide mechanism for vertically shifting the position of the upper frame, wherein, as a stepless stopper mechanism for stopping the slide in the slide mechanism in a stepless manner, a front-leg slide mechanism provided to a lower portion of the upper frame, and a rear-leg slide mechanism is provided to a rear-leg."

Patent document 2 discloses a stretcher in claim 1, which employs the following structure; i.e., "an under carriage, comprising a support structure attached to a frame structure capable of adjusting its height including a pair of first and second legs capable of being folded and an operating device for adjusting the height of the support structure, wherein the operating device includes a coupling device connected to the pair of first and second legs capable of being folded and the support structure, the coupling device is capable of being retracted or elongated to adjust the height of the support structure by extending or folding the pair of first and second legs." The device for vertically shifting the stretcher has the following structure. That is, "since the flexible coupling is energized being wound around on each spool, the spool is maintained under an appropriate spring tension. Each spool is provided with a ratchet mechanism and is arranged so that, when the ratchet mechanism is disengaged so as to allow the support structure to descend, the flexible coupling is released from the spool (pp. 3, left-upper column, 2nd line)." To release the flexible coupling from the spool, "the ratchet mechanism is provided with a cogwheel of a saw blade secured to the shaft of the spool so as to prevent the spool from rotating by a hook which engages with the saw blade as shown in FIG. 7 (pp. 4, lower-left column, 3rd line)."

Further, the patent document 3 claims the following stretcher in claim 1; "a main stretcher legs uprising mechanism comprising a gas damper with lock and a slide shaft pusher plate." The following structure is described; i.e., "as shown in FIG. 1, a gas damper with lock is secured to a lock & slide carrier assembly and a corresponding slide shaft pusher plate is secured to an I-beam. Likewise, a gas damper with lock is secured to the main frame and a corresponding slide shaft pusher plate is secured to a lock & slide carrier assembly (pp. 5, first line).

In the stretcher, which is loaded on an ambulance car, such structure that an emergency patient laid on the litter can be stably placed on the stretcher and swiftly loaded onto ambulance car without giving the emergency patient any pain or uneasiness is required. To achieve the above object, various inventions as described above have been proposed. However, it is desired to provide a new stretcher with a higher safe, which, when the stretcher is made vertically slide to adjust its height, makes less vibration and permits the ambulance crews to reliably operate the stretcher.

Patent document 1: International Publication No. WO02/051347

Patent document 2: Published patent application H07-504838, pp. 2

Patent document 3: Japanese Utility Model Registration No. 3058160, pp. 2

DISCLOSURE OF THE INVENTION

An object of the present invention is to provide a highly safety stretcher, which performs smooth vertical movement and, with a further reliable stopper mechanism, permits ambulance crews to perform their operation reliably. Another object of the present invention is to provide a stretcher capable of loading a litter onto the stretcher and reliably securing the litter on the stretcher, and a litter for stably loading a patient onto the stretcher.

In order to solve the above problems, as a result of intensive examinations, a stretcher capable of performing vertical movement smoothly, in which, in addition to a stop mechanism of a mechanical locking device, a lock mechanism is provided to front-leg auxiliary frame, has been successfully developed. Further, by forming an engagement groove in the front-end portion of the stretcher, and by engaging an engagement portion, which is provided to the front-end portion of the litter, with the engagement groove, a stretcher capable of loading a litter swiftly and stably onto the stretcher and a litter capable of being stably loaded thereon; thus, the above-mentioned problems have been solved.

Means for solving problem in accordance with the present invention is a stretcher, comprising:

an upper frame for loading a litter on its upper portion having castors on its front-legs and rear-legs;

a constant force spring in a slide mechanism for vertically changing the position of the upper frame; and a mechanical locking device for stopping the upper frame at an arbitrary position, wherein the stretcher provided with a lock mechanism for locking the slide of a front-leg auxiliary frame supporting the front-legs, and rollers for facilitating the slide between a center rail and each of supporters of the front-legs, a front-leg auxiliary frame and a rear-leg auxiliary frame supporting the rear-legs. By employing the constant force spring in the slide mechanism for vertically changing the height of the stretcher, an effect such that the vertical movement is performed smoothly. And thus, a patient can be relieved from uneasiness and pain caused from the vertical movement of the stretcher. By arranging the slide and stop for vertically changing the height of the stretcher are performed in a stepless manner, the stretcher is allowed to vertically slide and secured at an arbitrary position. Further, when the stretcher is moved vertically, undesired vibration is not given, and the patient can be relieved from pain and uneasiness. By employing the lock mechanism for securing the slide of the front-leg auxiliary frame, when the stretcher is loaded onto the stretcher base on the ambulance car, by unlocking the lock mechanism, the front-leg auxiliary frame pushes the front-leg backward and the front-leg is folded; thus, the stretcher can be smoothly loaded onto the stretcher base on the ambulance car. Further, by employing a further reliable stopper mechanism, a highly safety stretcher, which can be reliably operated by ambulance crews, is obtained. Furthermore, between the center rail and the respective supporters of the front-legs, the front-leg auxiliary frame and the rear-leg auxiliary frame, rollers for supporting the slide are provided. Thereby, the slide of the leg frames can be performed smoothly, and vibration due to the vertical movement of the stretcher base can be reduced.

Another means for solving problem in accordance with the present invention is the stretcher according to claim 1, wherein the front-leg auxiliary frame is provided with an auxiliary castor for facilitating the loading of the stretcher onto a stretcher base on an ambulance car. To the front-leg auxiliary frame, the auxiliary castor for supporting the loading of the stretcher onto the stretcher base on the ambulance car is provided. Owing to this, the stretcher can be smoothly loaded onto the stretcher base on the ambulance car; thus, a patient can be relieved from pain or uneasiness due to vibration and the like.

Another means for solving problem in accordance with the present invention is a stretcher, comprising:

an upper frame for loading a litter on its upper portion having castors on its front-legs and rear-legs;

a constant force spring in a slide mechanism for vertically changing the position of the upper frame; and a mechanical locking device for stopping the upper frame at an arbitrary position, wherein the stretcher is provided with a lock mechanism for locking the slide of a front-leg auxiliary frame supporting the front-legs, rollers for facilitating the slide between a center rail and each of supporters of the front-legs, a front-leg auxiliary frame and a rear-leg auxiliary frame supporting the rear-legs, an engagement groove of a trapezoid concave shape for securing the head side of a litter to a front end portion of the stretcher, and a stopper having a hook of a J-like shape for fixing the leg side of the litter to the rear-end portion of the stretcher. In the front end portion of the stretcher table of the stretcher, the engagement groove of a trapezoid concave shape is formed; and at the head side of the litter to be loaded on the stretcher, the engagement portion of a trapezoid convex shape to be engaged with the engagement groove is provided. Owing to this, when the litter is placed on the table of the stretcher and pushed from its rear side, the engagement portion of a convex shape provided at the head side of the litter comes into contact with the engagement groove of a concave shape of the stretcher, the engagement portion of trapezoid convex shape slides along the slopes of trapezoid concave shape, and the concave portion of the engagement groove of the stretcher engages with the convex potion of the engagement portion of the litter, thus, the litter can be strongly held on the table of the stretcher.

Another means for solving problem in accordance with the present invention is the stretcher according to claim 3, wherein the engagement groove for securing a mounted litter to the front-end portion of the stretcher has a trapezoid concave shape including slopes. The configuration of the engagement groove in the front-end portion of the stretcher is formed to a trapezoid concave shape including slopes. Therefore, even when the litter slides having a small displacement on the upper frame of the stretcher, the engagement portion of the litter, which has a convex shape including slopes, slides and proceeds along the slope of the engagement groove of the stretcher. Accordingly, the engagement groove of the stretcher and the engagement portion of the litter strongly engage with each other.

Another means for solving problem in accordance with the present invention is the stretcher according to claim 3, wherein the stopper for securing a mounted litter to the rear-end portion of the stretcher is a J-like shaped hook with energized spring. By the engagement portion provided to the head side of the litter and the engagement groove formed in the front-end portion of the stretcher, the head side of the litter and the front-end portion of the stretcher are strongly secured with each other. And further, by securing the leg side of the litter with the stopper having a hook, which is provided to the rear portion of the stretcher, the litter can be stably held on the stretcher.

Another means for solving problem in accordance with the present invention is a litter to be loaded on the stretcher set forth in claim 3, wherein an engagement portion for engaging with an engagement groove formed in the front-end portion of the stretcher is provided to the head side of the litter. In the front-end portion of the stretcher, the concave shape engagement groove for securing the head side litter is formed; and at the head side of the litter to be loaded on the stretcher, the convex shape engagement portion is provided. Owing to this, to load the litter on the stretcher, the litter is just pushed on the upper frame of the stretcher. Then, the engagement portion of the litter and the engagement groove of the stretcher engage with each other. Thus, the litter can be stably held on the stretcher.

Another means for solving problem in accordance with the present invention is the litter to be loaded on the stretcher according to claim 7, wherein the litter to be loaded on the stretcher is provided with a plurality of guide rollers for sliding on the upper frame of the stretcher. By providing the plurality of the guide rollers to the litter to be loaded on the stretcher, the litter can slide smoothly on the stretcher.

Another means for solving problem in accordance with the present invention is the litter to be loaded on the stretcher according to claim 7, wherein the engagement portion of the litter for engaging with the engagement groove formed in the front-end portion of the stretcher has a trapezoid convex shape including slopes. The engagement portion of the litter to be engaged with the engagement groove formed in the front-end portion of the stretcher is formed in a trapezoid convex shape including slopes. Owing to this, even when the litter is pushed on the stretcher having a small displacement, the engagement groove of a trapezoid concave shape including slopes of the stretcher and the engagement portion of the litter are reliably engaged with each other. Thus, the litter can be stably secured on the stretcher.

Another means for solving problem in accordance with the present invention is the litter to be loaded on the stretcher according to claim 7, wherein the litter is a backrest type litter provided with an engagement portion of a trapezoid convex shape at the head side of the litter for engaging with the engagement groove formed in the front end portion of the stretcher, the litter is provided with a backrest of which one end is rotatably pivoted thereto, and the other end of the backrest is rotatable in the vertical direction. The litter, which has the engagement portion of a trapezoid convex shape to be engaged with the engagement groove formed in the front-end portion of the stretcher, is arranged as the backrest type litter, in which one end of the backrest is pivoted rotatably, and the other end of the backrest is capable of rotating vertically. Owing to this, the litter can be used in the case where an emergency patient is treated with his/her body upraised.

Another means for solving problem in accordance with the present invention is the litter to be loaded on the stretcher according to claim 7, wherein the litter is provided with an engagement portion of a trapezoid convex shape at the head side of the litter for engaging with an engagement groove formed in the front end portion of the stretcher, a seat frame and a leg frame are attached to the litter, and the litter can be changed into a chair-like configuration. By using the litter to be loaded to the stretcher changed into a chair-like configuration, even in a narrow path, an emergency patient can be carried by one ambulance member.

Another means for solving problem in accordance with the present invention is the litter to be loaded on the stretcher according to claim 7, wherein the posts and castors of the litter are positioned at positions outer than the positions of the upper frames of the stretcher. By attaching the grips and castors of the litter so as to position out side of the upper frame of the stretcher, the grips and the castors of the litter sandwich the upper frame of the stretcher. Owing to this, the litter can be prevented from being displaced by vibration during the transportation of the stretcher, and the litter can be stably loaded on the stretcher.

BEST MODE FOR CARRYING OUT THE INVENTION

Figure 1:
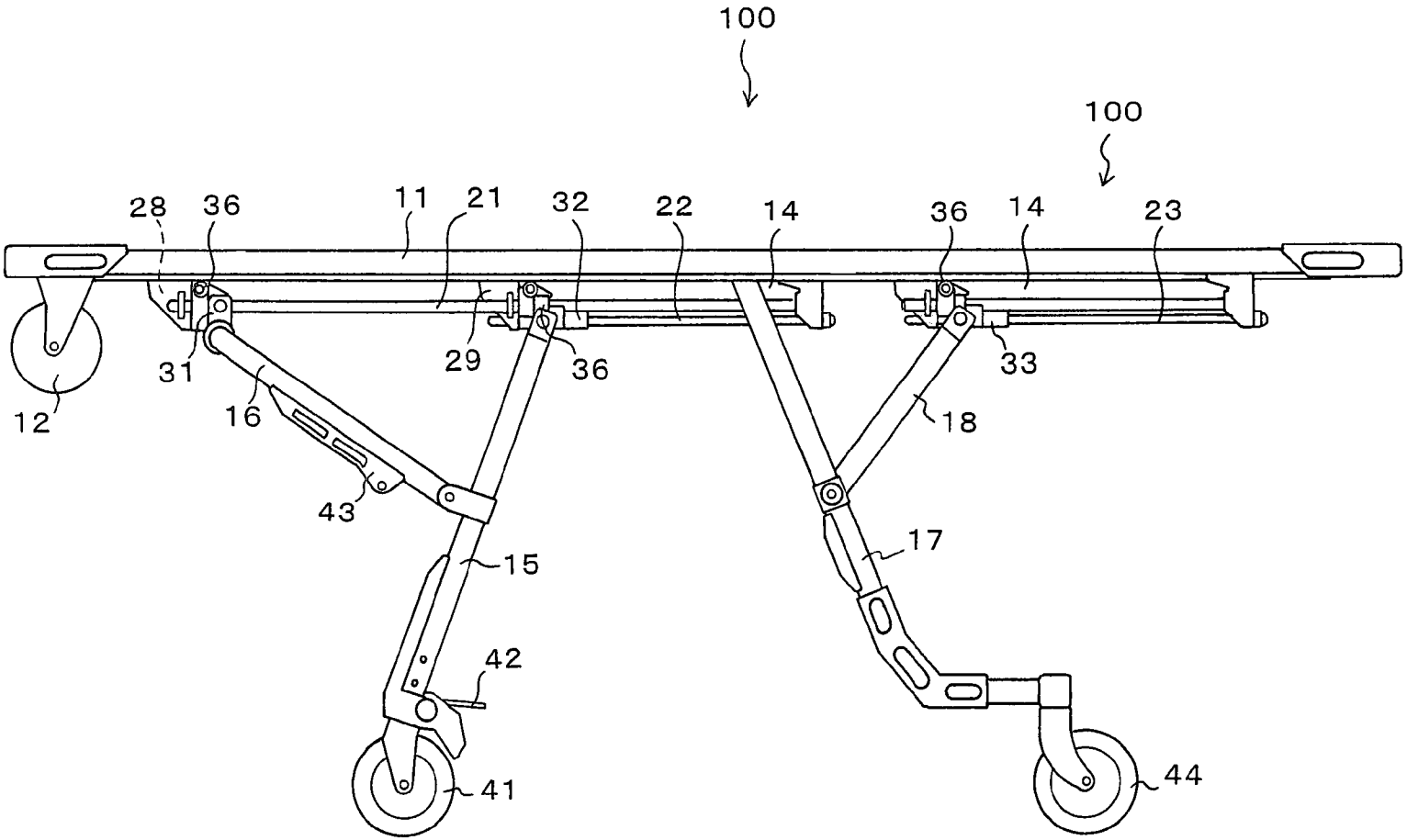
FIG. 1 is a side view of a stretcher.

Embodiments of the present invention will be described below with reference to the drawings and the reference numerals. However, the present invention is not limited to the embodiment described below. In the present invention, it is assumed that the wording "front-end portion" means a side of a stretcher closer to an ambulance car when the stretcher is loaded thereon. That is, the side where fixed castors are mounted is the front-end portion. Accordingly, when the stretcher is unloaded from the ambulance car, the stretcher is carried with its rear legs provided with rotatable castors oriented to the proceeding direction. Also, the wording "head side" of a litter indicates the side identical to the front-end portion of the stretcher; and the wording "leg side" of the litter indicates the side equivalent to the rear-end portion of the stretcher.

As shown in FIG. 1, a stretcher 100 in accordance with the present invention has an upper frame 11 of a rectangular shape in the upper portion thereof. In the front portion of the upper frame, fixed castors 12 are attached so that the stretcher 100 can be smoothly pushed onto a stretcher base and loaded on an ambulance car. Further, the upper frame 11 is provided with a plurality of inner frames 13 (unshown). A center rail 14 is attached to the inner frames 13. Attached to the both sides of the center rail 14 are front-leg auxiliary frame sliding pipes 21, front-leg sliding pipes 22 and the rear-leg auxiliary frame-sliding pipes 23.

The configuration of the pipe for the upper frame 11 of a rectangular shape is not specifically limited. However, in the present invention, a pipe, which is of an elliptic section and 29×34 mm in length, is used for the upper frame 11 to reinforce the same. As for the fixed castors 12, a 4-inch wheel may be employed, but in the present invention, a 5-inch wheel is employed. As for the center rail 14, a rail of U-like shape having an 80×40 channel is employed.

Figure 2:
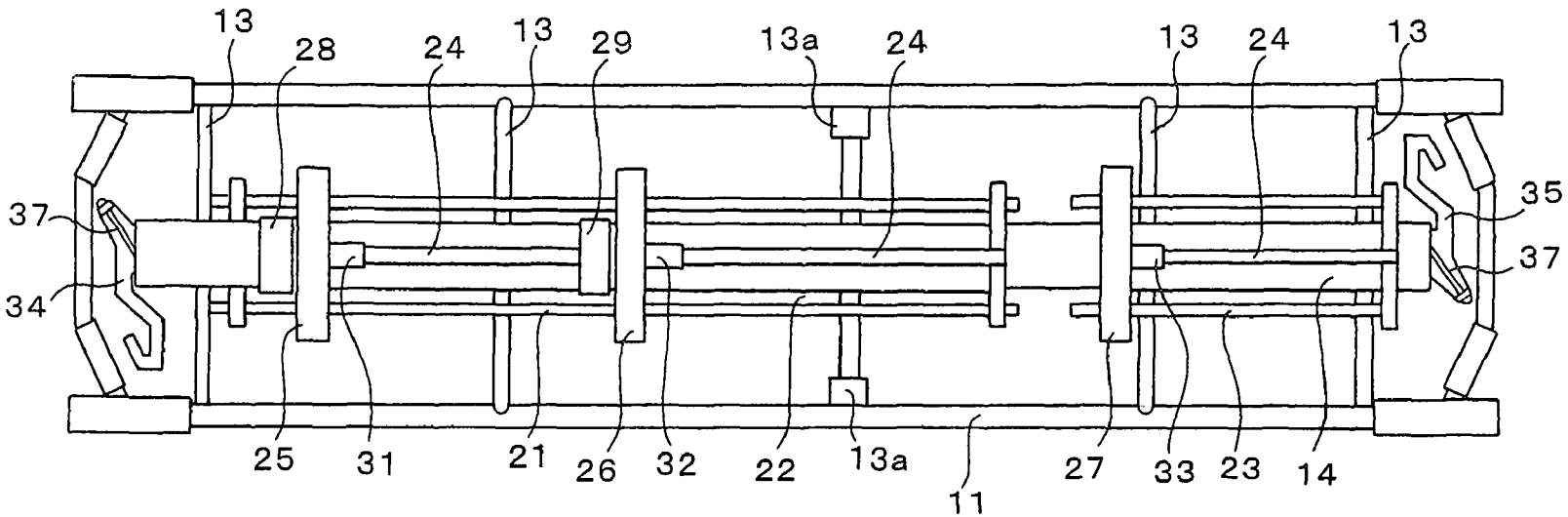
FIG. 2 is a side view of the stretcher.

FIG. 2 is a bottom view of the upper frame of the stretcher 100 in accordance with the present invention. In FIG. 2, in order to simply show each frame structure, the leg sections are omitted. As shown in FIG. 2, five inner frames 13 are provided being bridged inside the upper frame 11, and the center rail 14 is attach thereto. Attached to the both sides of the center rail 14 are front-leg auxiliary frame sliding pipes 21, front-leg sliding pipes 22 and rear-leg auxiliary frame sliding pipes 23. Being engaged with each of the sliding pipes 21, 22 and 23, a front-leg auxiliary frame supporter 25, a front-leg supporter 26 and a rear-leg auxiliary frame supporter 27 are inserted therethrough in a slidable manner.

Attached between the respective sliding pipes 21, 22 and 23, which are provided to the both sides of the center rail 14, are guide pipes 24. Being engaged with the guide pipes 24, mechanical locking devices 32 and 33 that control the movement of the front-leg auxiliary frame supporter 25, the front-leg supporter 26, and the rear-leg auxiliary frame supporter 27 are inserted therethrough. These mechanical locking devices 32 and 33 are connected to levers 34 and 35 by means of a wire 37. When the levers 34, 35 at the both sides are pulled, mechanical locking devices 32 and 33 are unlocked and the stretcher can be adjusted to an arbitrary height. The front lever 34 is for unlocking the mechanical locking device. The rear lever 35 is for engaging/disengaging a pin for locking a lock mechanism 31 of a front-leg auxiliary frame 16, which will be described later, as well as for unlocking its mechanical locking device. To load the stretcher onto the stretcher base of the ambulance car, when the rear lever 35 is pulled, the pin, which locks the lock mechanism 31 of the front-leg auxiliary frame 16, is pulled out, and the mechanical locking device is unlocked. When the stretcher is pushed forward, the front-leg auxiliary frame comes into contact with the stretcher base of the ambulance car and is pushed backward, and the front-leg frame is folded backward. Thus, the stretcher can be loaded smoothly onto the stretcher base of the ambulance car.

Further, as shown in FIG. 2, being engaged with the front-leg auxiliary frame sliding pipes 21, the front-leg auxiliary frame supporter 25 having auxiliary castors 43 is inserted. Being engaged with the front-leg sliding pipes 22, the front-leg supporter 26 provided with the fixed castors 41 are inserted in a slidable manner. The rear legs 17, which have rotatable castors 44, are pivotally attached to an inner frame 13*a* provided in a substantially central area of the upper frame 11. Rear-leg auxiliary frames 18 are attached rotatably to rear-leg auxiliary frame supporter 27 inserted by the rear-leg auxiliary frame sliding pipes 23 in the rear portion.

A constant force spring 28 is attached to a point in front of the front-leg auxiliary frame supporter 25, and a constant force spring 29 is attached to a point in front of the front-leg supporter 26. In this embodiment, for the constant force spring 28 at the front-leg auxiliary frame supporter 25 side, a 4 kg constant force spring is employed; and for the constant force spring 29 at the front-leg supporter 26 side, a 9 kg constant force spring is employed. Here, as for the constant force springs 28 and 29, a spiral spring or the like capable of achieving the object without requiring a large space is preferably employed. However, an ordinary coil spring capable of supporting the vertical movement of the stretcher may be employed. The position for attaching these constant force springs 28 and 29 is not limited to the above-mentioned two points. A constant force spring may be attached to a point at the rear-leg auxiliary frame supporter 27 side. The constant force springs are not specifically limited, but depending on the material and structure of the stretcher 100, constant force springs of approximately 4 kg to 15 kg are preferably employed. However, in the case where the value of the constant force spring is too small, when the stretcher 100 is shifted vertically, the constant force spring returns too slowly. Contrarily, in the case where the value of the constant force spring is too large, when the stretcher 100 is shifted vertically, the constant force spring returns too fast causing uneasiness to a patient. Therefore, it is preferred to employ an appropriate constant force spring.

Figure 3:
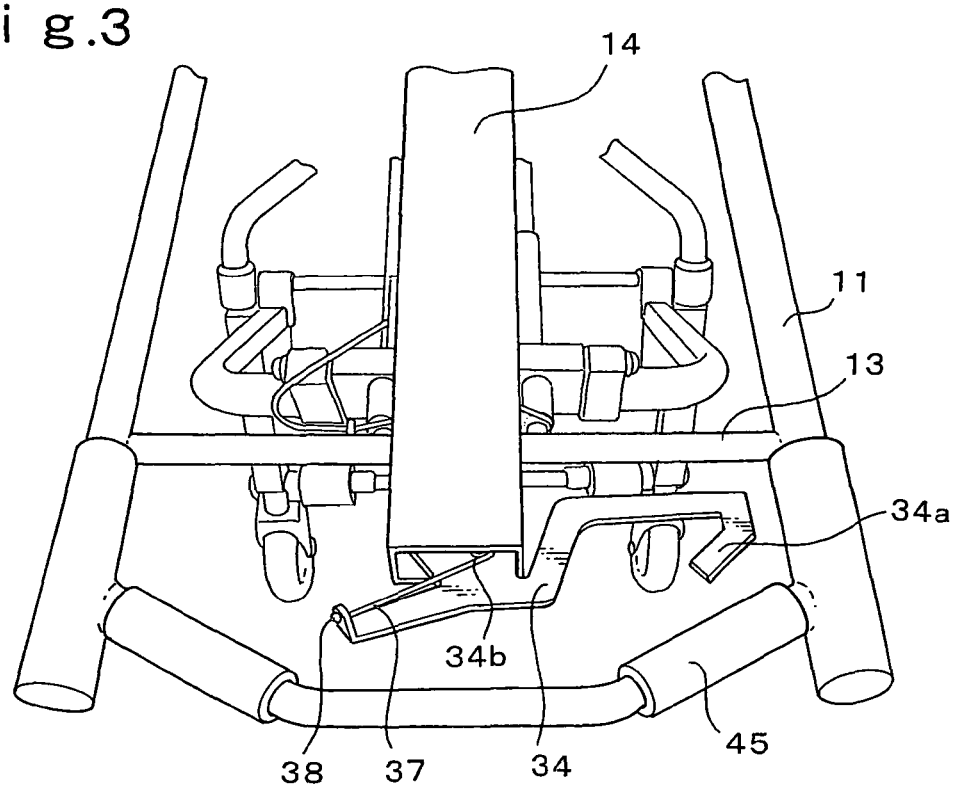
FIG. 3 is a top view of a lever.

As shown in FIG. 3, the configuration of the lever 34 or 35 for operating the mechanical locking devices 32 and 33 or a pin lock mechanism 31 is arranged as described below; i.e., the lever 34 or 35 rotates around a pivoted portion 34*b* as the fulcrum; and the other end of the grip 34*a* is elongated, and to the front end thereof, a wire 37 is connected. A mechanism is arranged so that, when the grip 34*a* is pulled, the wire 37 connected to the wire-connecting portion 38 of the other end is pulled, thus the mechanical locking devices 32 and 33, or the pin lock mechanism 31, or the both of them are unlocked.

Figure 4:
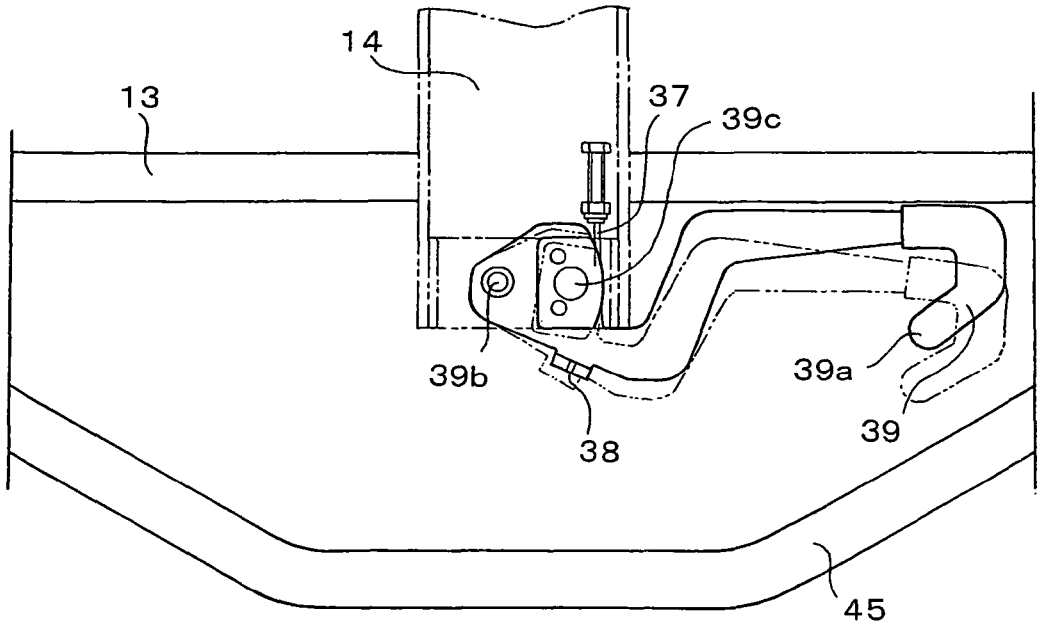
FIG. 4 is a perspective view of the lever.

As another example of the lever, an arrangement shown in FIG. 4 is given. The lever 39 shown in FIG. 4 is arranged so that a roller 39*c* is attached to a point in front of a fulcrum 39*b* and a wire 37, which is connected to the wire-connecting portion 38 of the lever 39, slides on the roller 39*c*. Thus, the following mechanism is achieved. That is, when the grip 39*a* is pulled, the wire 37 connected to the wire-connecting portion 38 is also pulled, and the mechanical locking devices 32 and 33, or the pin lock mechanism 31, or both of them are unlocked. Unlike the lever 34 and 35 shown in FIG. 3, since the wire-connecting portion 38 is positioned at a point inner than the fulcrum 39*b*, the entire of the lever can be arranged smaller in size.

Figure 5:
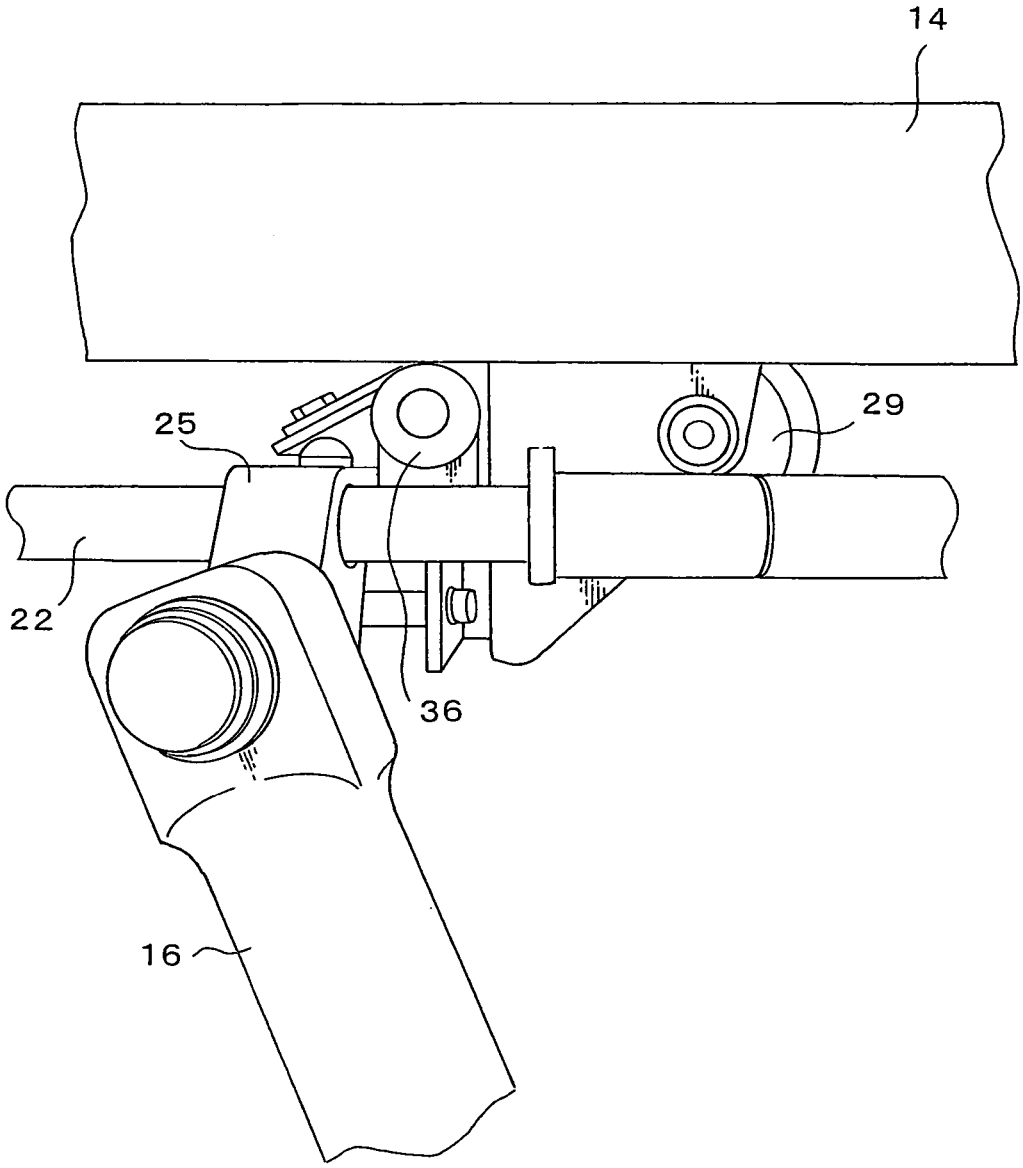
FIG. 5 is a perspective view of a roller-mounting portion.

As shown in FIG. 5, a plurality of rollers 36 is provided between each of the supporters of the front-leg auxiliary frame supporter 25, the front-leg supporter 26 and the rear-leg auxiliary frame supporter 27 and the center rail 14. By providing the rollers 36 between the center rail 14 and the front-leg auxiliary frame supporter 25, the front-leg supporter 26 and the rear-leg auxiliary frame supporter 27, the following effect is obtained. That is, the leg-frame supporters 25, 26 and 27 slide smoothly on the sliding pipes 21, 22 and 23 and bear the load of the center rail 14.

Figure 6:
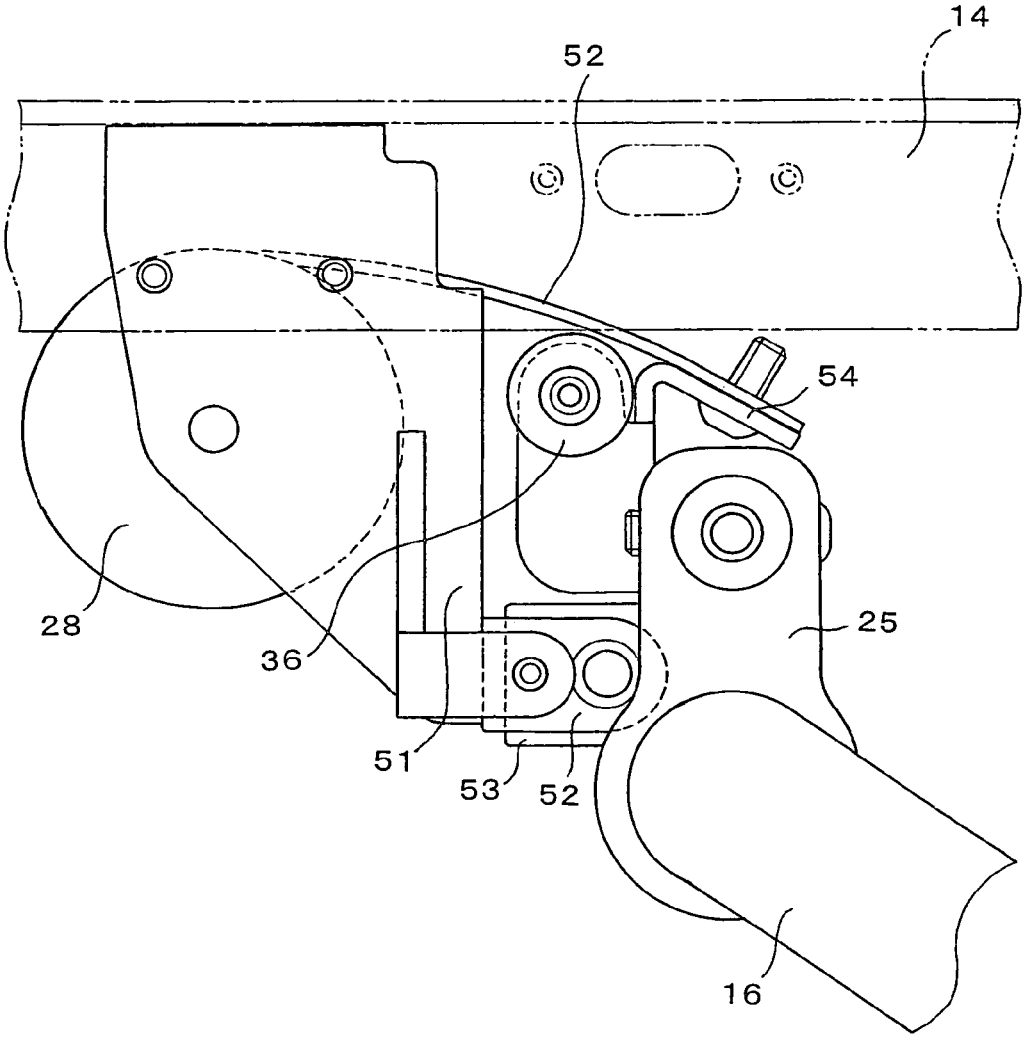
FIG. 6 is a side view of a constant force spring and a roller.

FIG. 6 is a side view of the mounting portion of a roller 36. A shown in FIG. 6, the rollers 36 are provided in contact with the center rail 14. To one side of the roller 36, the constant force spring 28' is attached; and to the other side of the roller 36, a spring fixing section 54 for securing the spring 52 of the constant force spring 28 is attached. Below the roller 36, the pin 52 and a pin engagement section 53 of the lock mechanism 31 are positioned.

Figure 7:
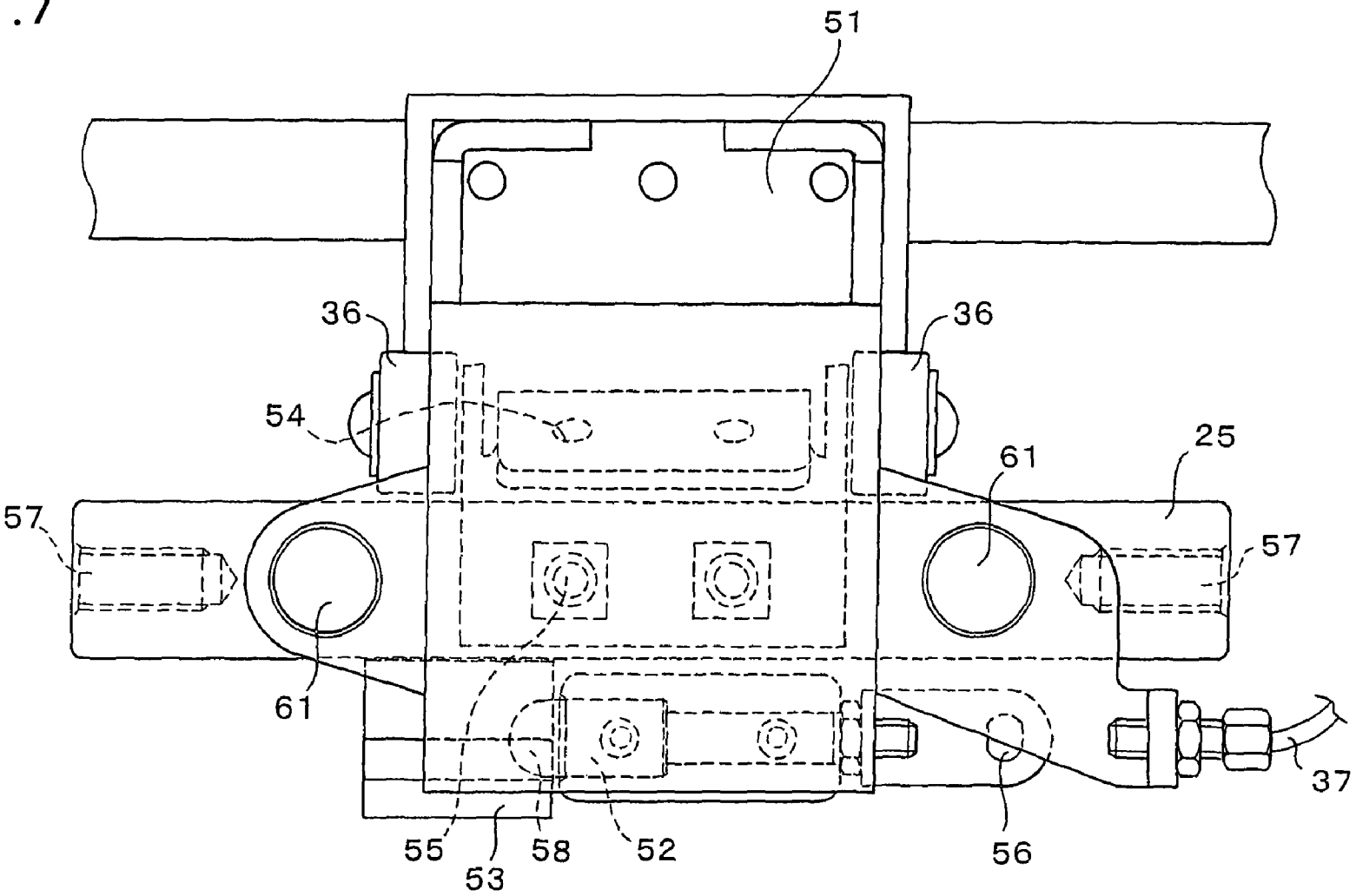
FIG. 7 is a top view of a front-leg auxiliary frame supporter and rollers.

The lock mechanism 31, which locks the movement between the rollers 36 and the front-leg auxiliary frame 16, is provided to the front-leg auxiliary frame supporter 25, and has a structure shown in FIG. 7. On the upper face of the front-leg auxiliary frame supporter 25, a cover 51 is positioned, and under the cover 51, the front-leg auxiliary frame supporter 25 is positioned. The rollers 36 are secured to a roller fixing section 55 of the front-leg auxiliary frame supporter 25 with screws. The sliding pipes 21 are inserted through sliding pipe insertion sections 61 so as to allow the front-leg auxiliary frame supporter 25 to slide. The lock mechanism 31 of the front-leg auxiliary frame supporter 25 is functioned by engaging/disengaging pin 52 attached to the cover 51. The pin 52 is engaged/disengaged by the operation of the wire 37 connected to the lever 35 provided to the rear portion of the upper frame. The wire 37 is connected to a wire stopper 56 formed in the end portion of the pin. When the lever 35 is pulled, the pin 52 is pulled out from a pin engagement hole 58, and the front-leg auxiliary frame supporter 25 becomes slidable.

Figure 8:
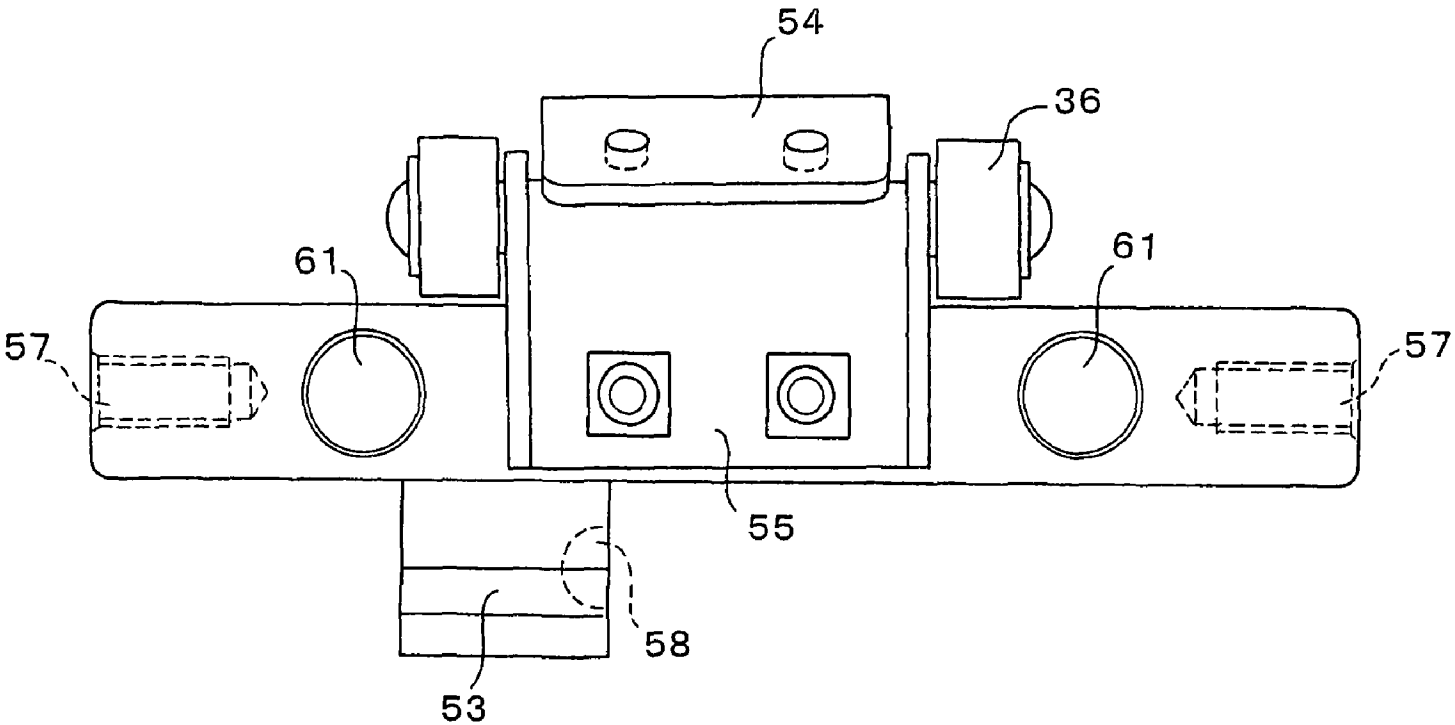
FIG. 8 is a top view of the front-leg auxiliary frame supporter and a pin stopper.

When the pin 52 is pulled out from the pin engagement hole 58, the slidable front-leg auxiliary frame supporter 25 comes into contact with the stretcher base of the ambulance car, and slides toward the center of the stretcher. As shown in FIG. 8, the front-leg auxiliary frame supporter 25 includes the sliding pipe insertion sections 61 and front-leg auxiliary frame mounting sections 57. The rollers 36 are attached to the roller fixing section 55 of the front-leg auxiliary frame supporter 25 with screws so that the rollers 36 are in contact with the center rail 14. To the spring fixing section 54 on the rollers 36, a spring of constant force spring 28 is secured with screws. To the lower portion of the front-leg auxiliary frame supporter 25, the pin engagement section 53 is formed. In the present invention, the lock mechanism 31 using the pin is provided only to the front-leg auxiliary frame supporter 25. However, the lock mechanism may be provided to other leg section, for example, to the front-leg supporter 26, the rear-leg auxiliary frame supporter 27 or the like.

Figure 9:
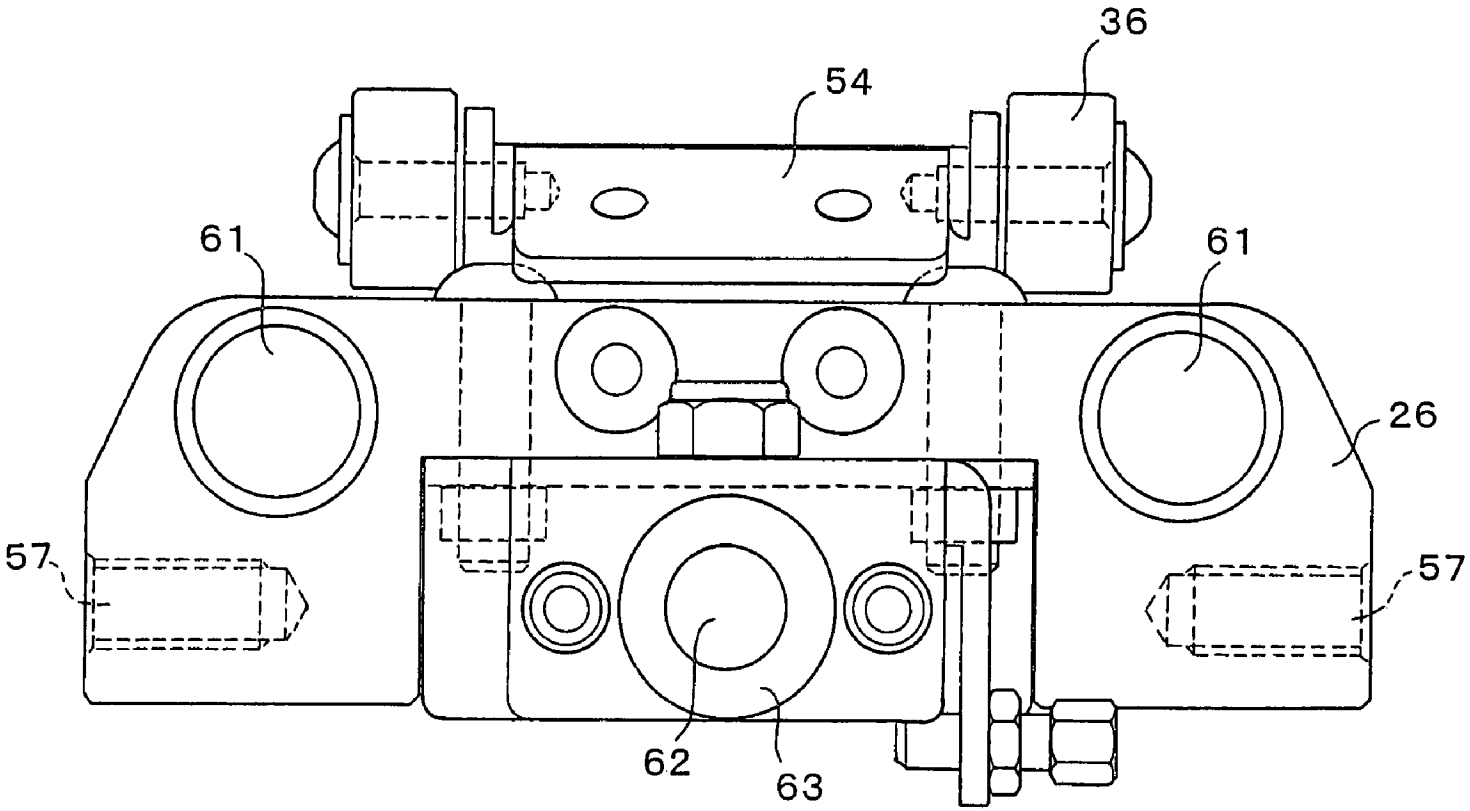
FIG. 9 is a rear view of the leg support and the roller.

FIG. 9 is a rear view of the front-leg supporter 26 or the rear-leg auxiliary frame supporter 27. The upper portion of the front-leg supporter 26 has a spring fixing section 54 of the rollers 36 and the constant force spring 29, and in the both sides thereof, the sliding pipe insertion sections 61 are formed. The mechanical locking device 32 is mounted on the mechanical locking device mounting section 63 located in the lower portion, and the guide pipe 24 is inserted through the guide pipe insertion section 62 in the central area thereof. The mechanical locking device 32 sandwiches the guide pipe 24 to secure the front-leg supporter 26 at an arbitrary position. When the levers 34 and 35 are pulled, the mechanical locking devices 32 and 38 are unlocked. After adjusting the height of the stretcher at an arbitrary position, when the levers 34 and 35 are released, the mechanical locking devices 52 and 33 are locked. Although the rear-leg auxiliary frame supporter 27 is not provided with any constant force spring, if necessary, a constant force spring may be provided thereto.

Figure 10:
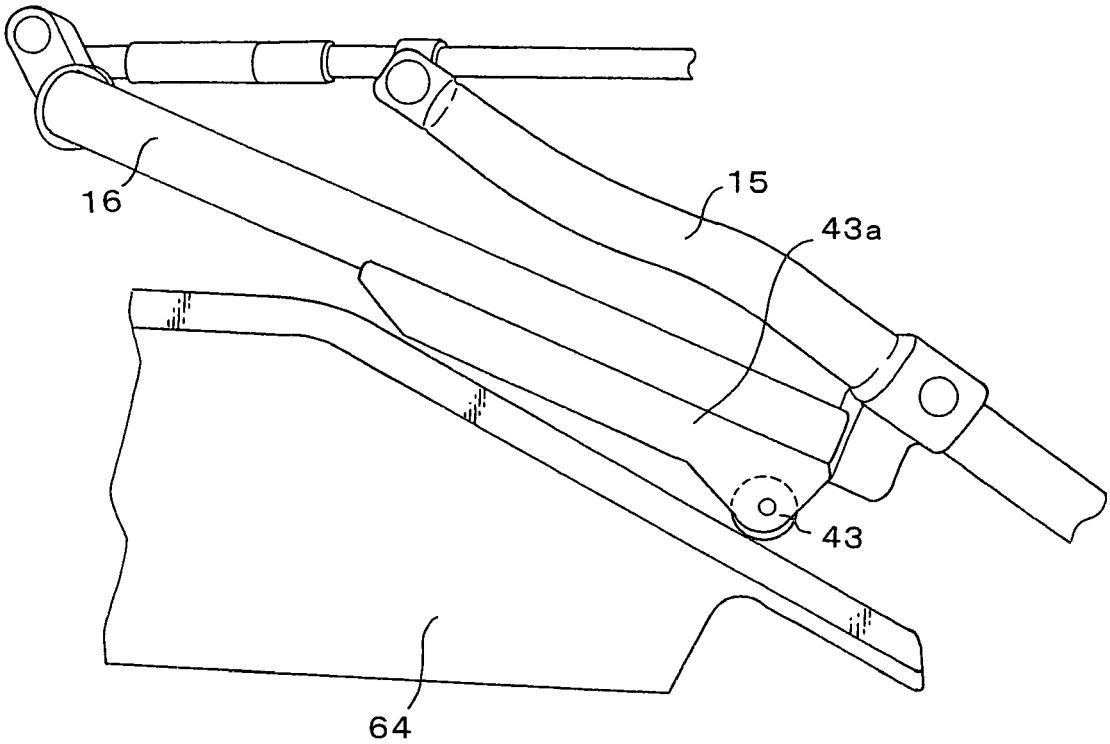
FIG. 10 is a side view of a stretcher base on an ambulance car and an auxiliary castor portion.

As shown in FIG. 10, in a portion of the front-leg auxiliary frame 16, with which the stretcher base 64 comes into contact, an auxiliary castor 43 is provided. Thereby, the front-leg auxiliary frame 16 can be smoothly pushed up on the slope of stretcher base 64 on the ambulance car, and thus, the stretcher 100 can be smoothly loaded onto the stretcher base on the ambulance car.

Figure 11:
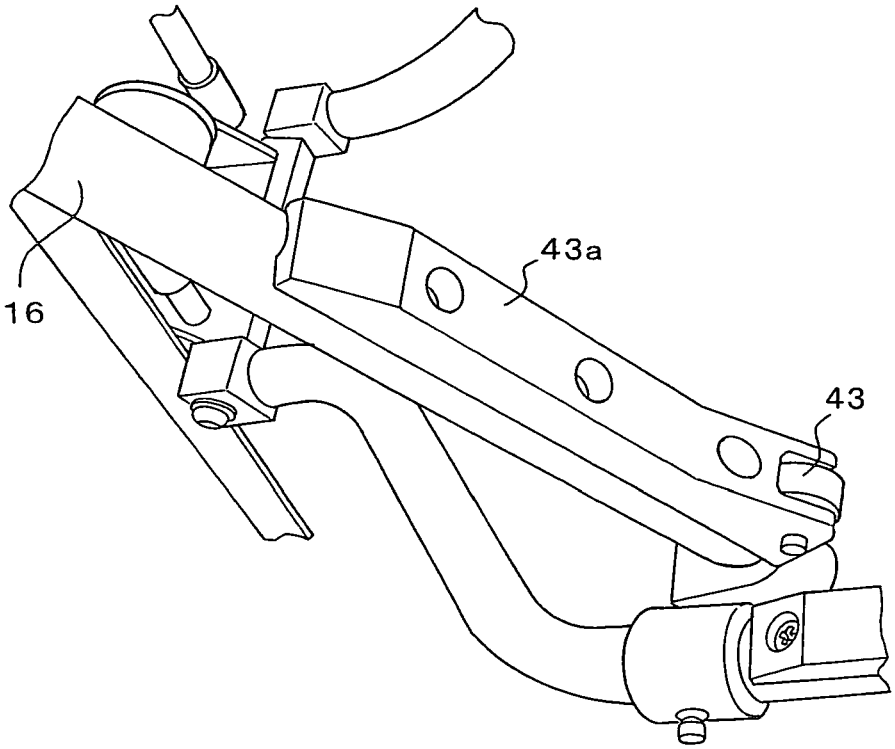
FIG. 11 is a perspective view showing of the auxiliary castor portion viewed from the bottom thereof.

As shown in FIG. 11, the sliding section 43*a*, to which the auxiliary castor 43 is mounted, is formed of a hard synthetic resin. A portion, to which the castor is attached, is formed thicker than the other portion. In a portion with which the stretcher base on the ambulance car comes into contact, a slope is formed. At the side of the sliding section 43*a*, which comes into contact with the front-leg auxiliary frame 16, a groove, which agrees with the shape of the frame, is formed, and secured to the front-leg auxiliary frame 16 with screws.

Figure 12:
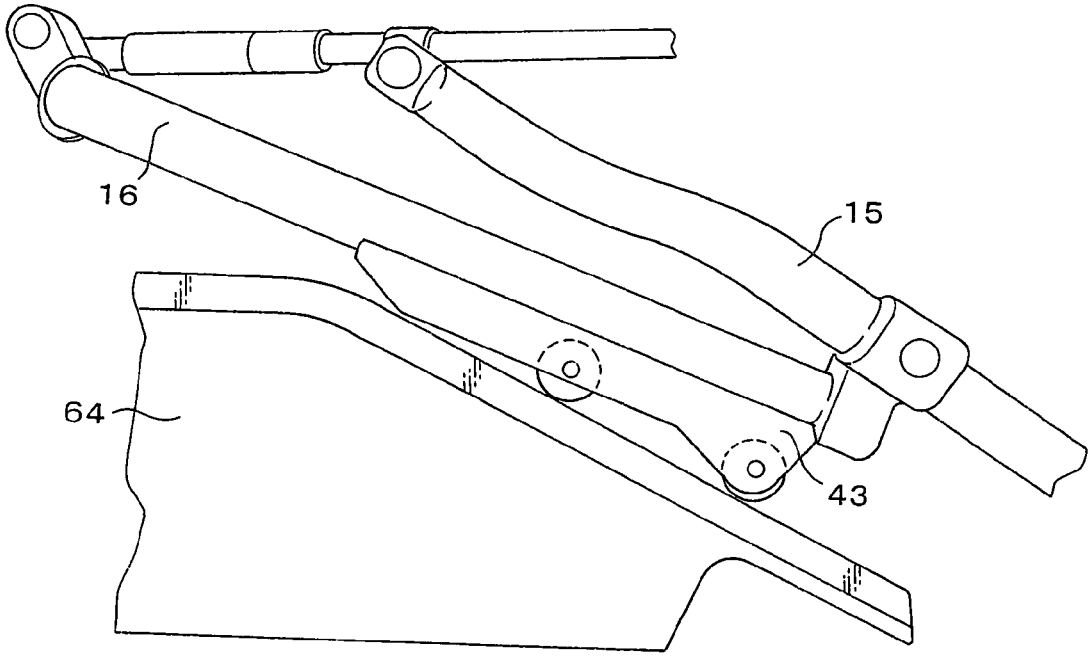
FIG. 12 is a side view of the stretcher base on the ambulance car and the auxiliary castor portion.

As shown in FIG. 10, in the case where a single auxiliary castor 43 is provided to the front-leg auxiliary frame 16, the sliding section 43*a* of the auxiliary castor comes into contact with the peak of the stretcher base. Therefore, the stretcher has to be pushed up in a state that the front portion thereof is lifted up. To relieve the uneasiness of an emergency patient, two auxiliary castors are provided as shown in FIG. 12. Thereby the sliding section of the stretcher is prevented from coming into contact with the peak of the stretcher base. Only by being pushed from the rear side, the stretcher can be easily loaded onto the stretcher base on the ambulance car.

Figure 13:
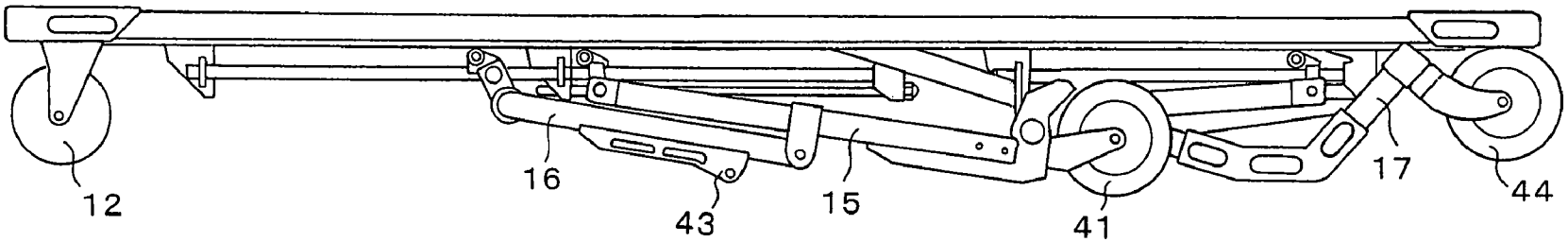
FIG. 13 is a side view of the leg section of the stretcher when the leg section is folded.

When loading the stretcher 100 on the ambulance car, the rear lever 35 of the stretcher 100 is operated to unlock the lock mechanism of the front-leg auxiliary frame 16. And when the stretcher 100 is pushed forward, the front-leg auxiliary frame 16 comes into contact with the stretcher base on the ambulance car and is folded backward. The auxiliary castor 43 provided to the front-leg auxiliary frame 16 comes into contact with the stretcher base on the ambulance car, thus the stretcher 100 can be smoothly pushed onto the stretcher base. When the stretcher 100 is further pushed forward, the rear legs 17 are folded in a state as shown in FIG. 13; thus the stretcher 100 can be loaded onto the stretcher base on the ambulance car.

Figure 14:
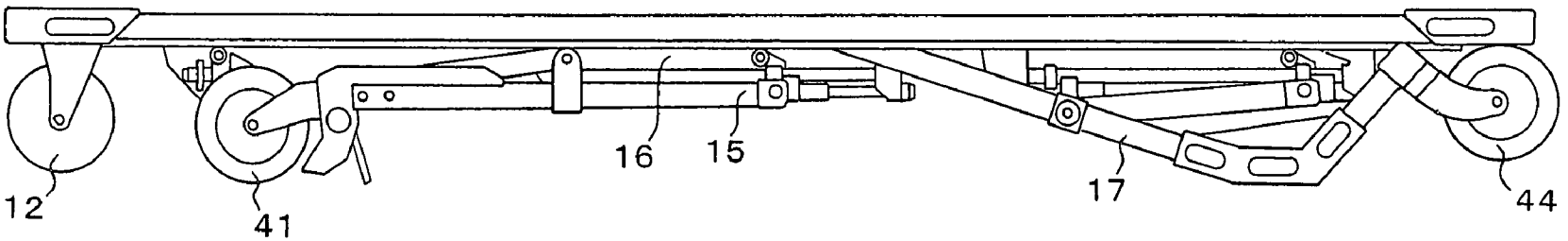
FIG. 14 is a side view of the stretcher with folded leg sections.

When the stretcher 100 is pushed up without unlocking the front-leg auxiliary frame 16 (without pulling the lever 35) but the mechanical locking device is unlocked, as shown in FIG. 14, the front legs 15 and the castors 41 provided thereto are folded forward, and the rear legs 17 and the castors 44 provide thereto are folded backward.

Figure 15:
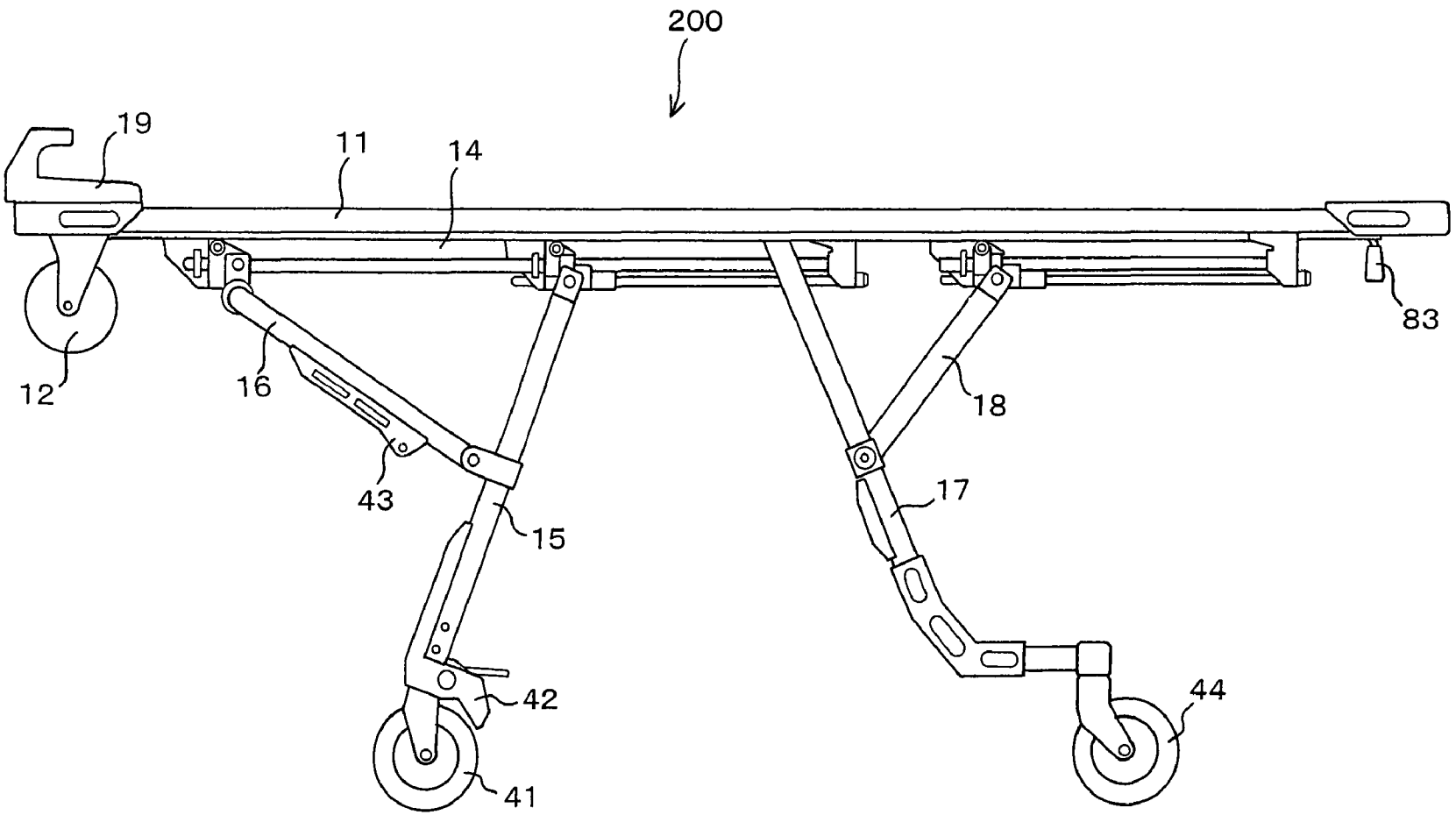
FIG. 15 is a side view of the stretcher having a concave portion for engaging with an engagement portion of the litter.

In a stretcher 200 in accordance with the present invention, as shown in FIG. 15, the stretcher 200 has an upper frame 11 of a rectangular shape in the upper portion thereof, and to the front portion of the upper frame 11, a fixed castor 12 is attached so that the stretcher 200 can be smoothly pushed and loaded onto the stretcher base on the ambulance car. Provided in the upper portion of the center frame 14 is an engagement groove section 19 having engagement grooves, which receives the litter loaded from the rear side. An engagement portion of the litter engages with the engagement groove formed in the engagement groove section 19, and a stopper of the litter provided in its rear portion holds the litter stably on the stretcher. Further, the upper frame 11 is provided with a plurality of inner frames 13 (unshown). A center rail 14 is attached to the inner frames 13. At the both sides of the center rail 14, front-leg auxiliary frame sliding pipes 21, front-leg sliding pipes 22 and rear-leg auxiliary frame sliding pipes 23 are attached.

The configuration of the pipe for the upper frame 11 having a rectangular shape is not specifically limited. In the present invention, a pipe of 29×34 mm in elliptic section is used for the upper frame 11 to reinforce the upper frame 11. For the fixed castor 12, a 4-inch wheel may be employed. In the present invention, a 5-inch wheel is employed. For the center rail 14, a rail of 80×40 U-like shape cannel is employed.

Figure 16:
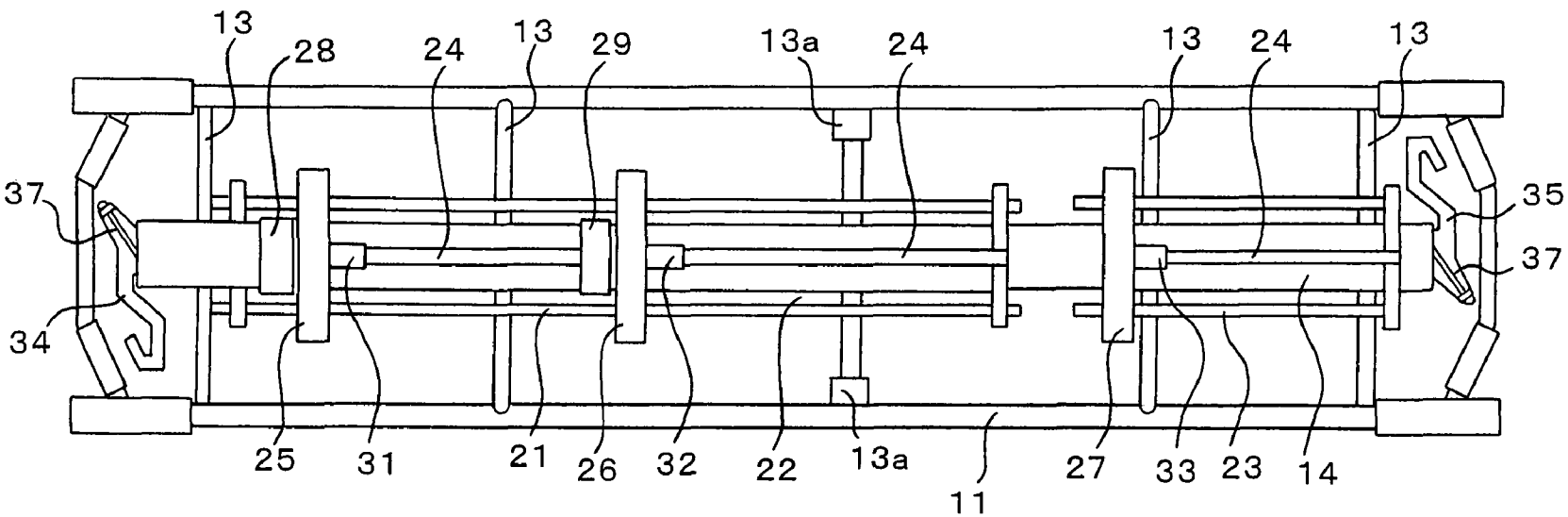
FIG. 16 is a bottom view of the upper frame of the stretcher.

FIG. 16 is a bottom view of the upper frame of the stretcher 200 in accordance with the present invention. In FIG. 16, to simply illustrate each frame structure, the leg sections of the stretcher are omitted. As shown in FIG. 16, five inner frames 13 are bridged inside the upper frame 11, and a center rail 14 is attached thereto. At the both sides of the center rail 14, the front-leg auxiliary frame sliding pipes 21, the front-leg sliding pipes 22 and the rear-leg auxiliary frame sliding pipes 23 are attached thereto. These sliding pipes 21, 22 and 23 are inserted through a front-leg auxiliary frame supporter 25, a front-leg supporter 26 and a rear-leg auxiliary frame supporter 27 being engaged therewith in a slidable manner. Further, guide pipes 24 are provided between each of the sliding pipes 21, 22 and 23 provided at the both sides of the center rail 14. The guide pipes 24 are inserted through the front-leg auxiliary frame supporter 25, the front-leg supporter 26, and the rear-leg auxiliary frame supporter 27 and mechanical locking devices 32 and 33 for controlling the movement. The mechanical locking devices 32 and 33 are connected to levers 34 and 35 with a wire 37. When both of the levers 34 and 35 are pulled, the mechanical locking devices 32 and 33 connected to the wire 37 are unlocked. Thus, the stretcher can be adjusted and secured at an arbitrary height. The front side lever 34 is for unlocking the mechanical locking devices. The rear side lever 35 is for engaging/disengaging a pin locking the lock mechanism 31 of the front-leg auxiliary frame 16, which will be described later, as well as for unlocking the mechanical locking devices. When loading the stretcher onto the stretcher base on the ambulance car, the rear lever 35 is pulled to pull out a pin locking the lock mechanism 31 of the front-leg auxiliary frame 16, and the mechanical locking devices 32 and 33 are unlocked. When the stretcher is pushed forward, the front-leg auxiliary frame 16 comes into contact with the stretcher base on the ambulance car and pushed backward, and the front-leg frame 15 is folded backward. Thus, the stretcher can be loaded smoothly on the stretcher base of the ambulance car.

Figure 17:
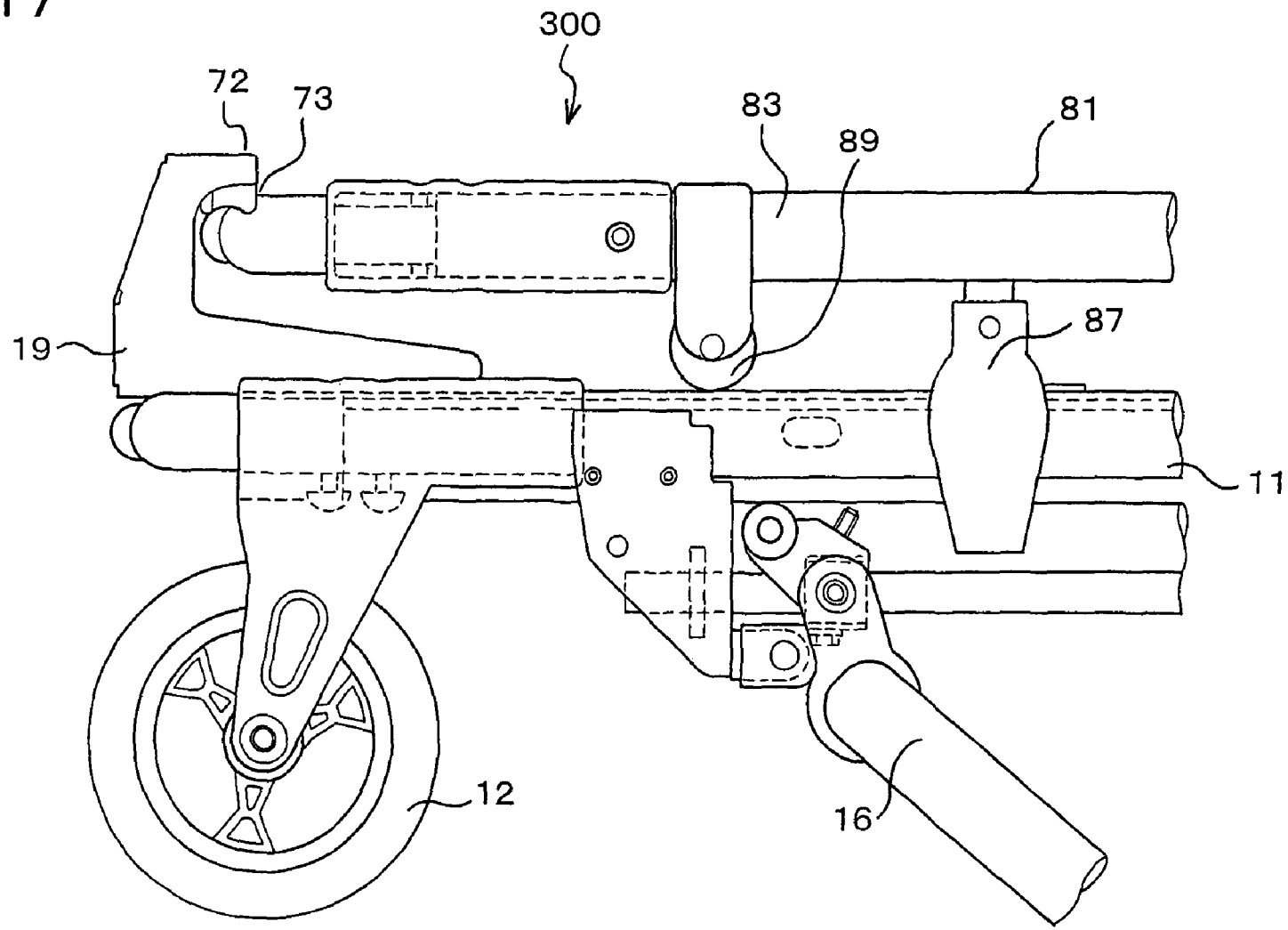
FIG. 17 is a side view of a portion engaged with an engagement groove of the stretcher.
Figure 18:
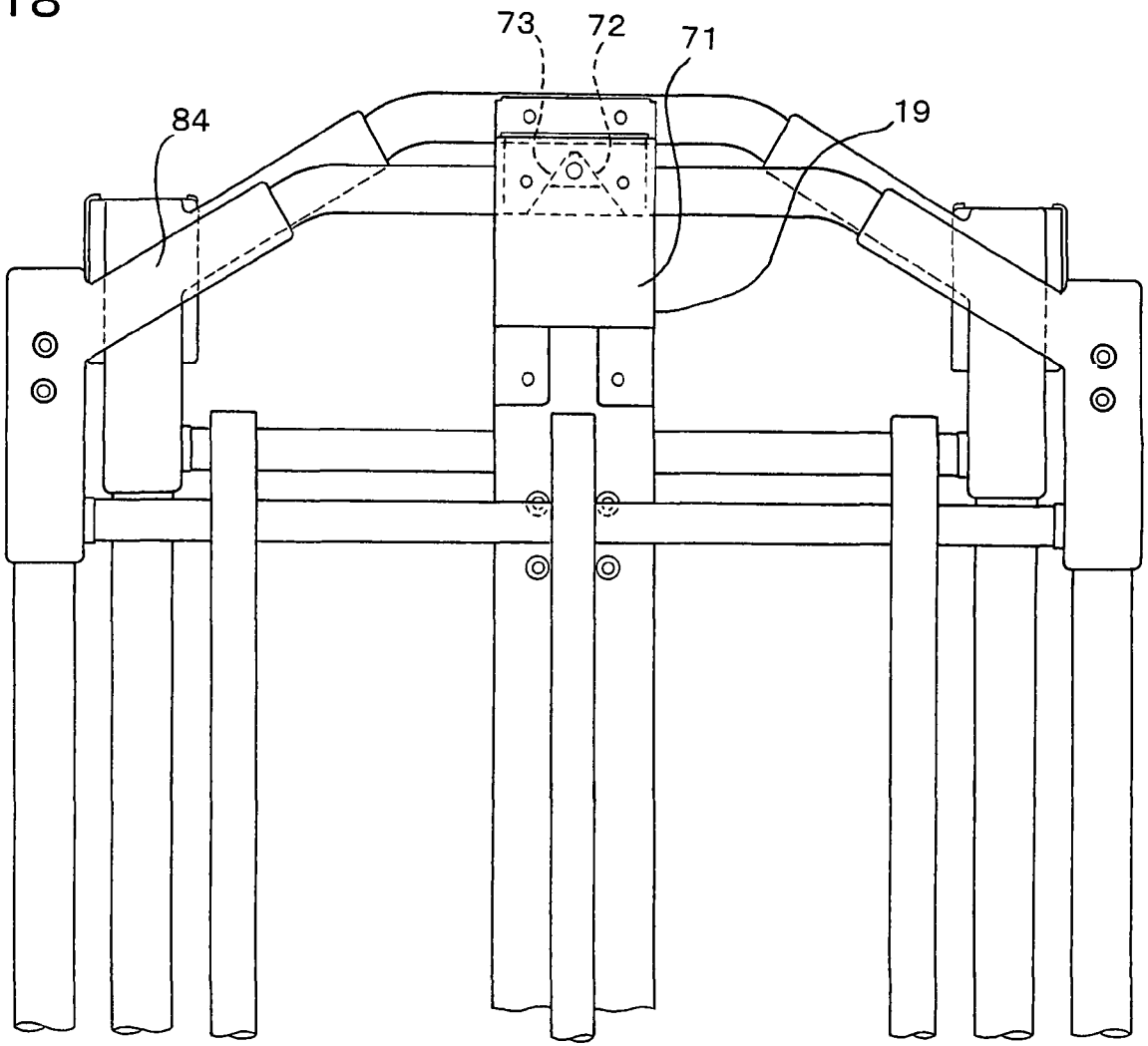
FIG. 18 is a top view of a portion engaged with the engagement groove of the stretcher.

FIG. 17 is a partial side view showing a litter 300 loaded on the stretcher. The litter, which slides from the rear side of the stretcher on the upper frame by means of guide rollers 89, is stably held on the stretcher by an engagement groove 72 of the stretcher and an engagement portion 73 of the litter engaged with each other. FIG. 18 shows the engagement portion between the engagement groove 72 and the engagement portion 73. The engagement groove 72 is formed in a trapezoid concave shape having slopes on both side surfaces and is covered with a cover of the engagement groove in the front-end portion of the stretcher. The engagement portion 73, which is provided to the head side of the litter so as to engage with the engagement groove 72, is formed in a trapezoid convex shape having slopes on both side surfaces. Here, the trapezoid concave shape and the trapezoid convex shape having slopes are not limited to a trapezoid shape in which a peak of a triangle is removed, but may be a triangle shape having its peak. By employing a configuration including slopes on the both side surfaces of trapezoid shape, It is arranged so that, even when the litter 300 is pushed with a slight displacement with respect to the stretcher from the rear side of the stretcher, the slopes of the trapezoid engagement portion 73 slides along the slopes of the trapezoid engagement groove 52. And thus, the engagement portion 73 engages with engagement groove 72 at the center thereof, and the litter is held stably on the stretcher.

Figure 19:
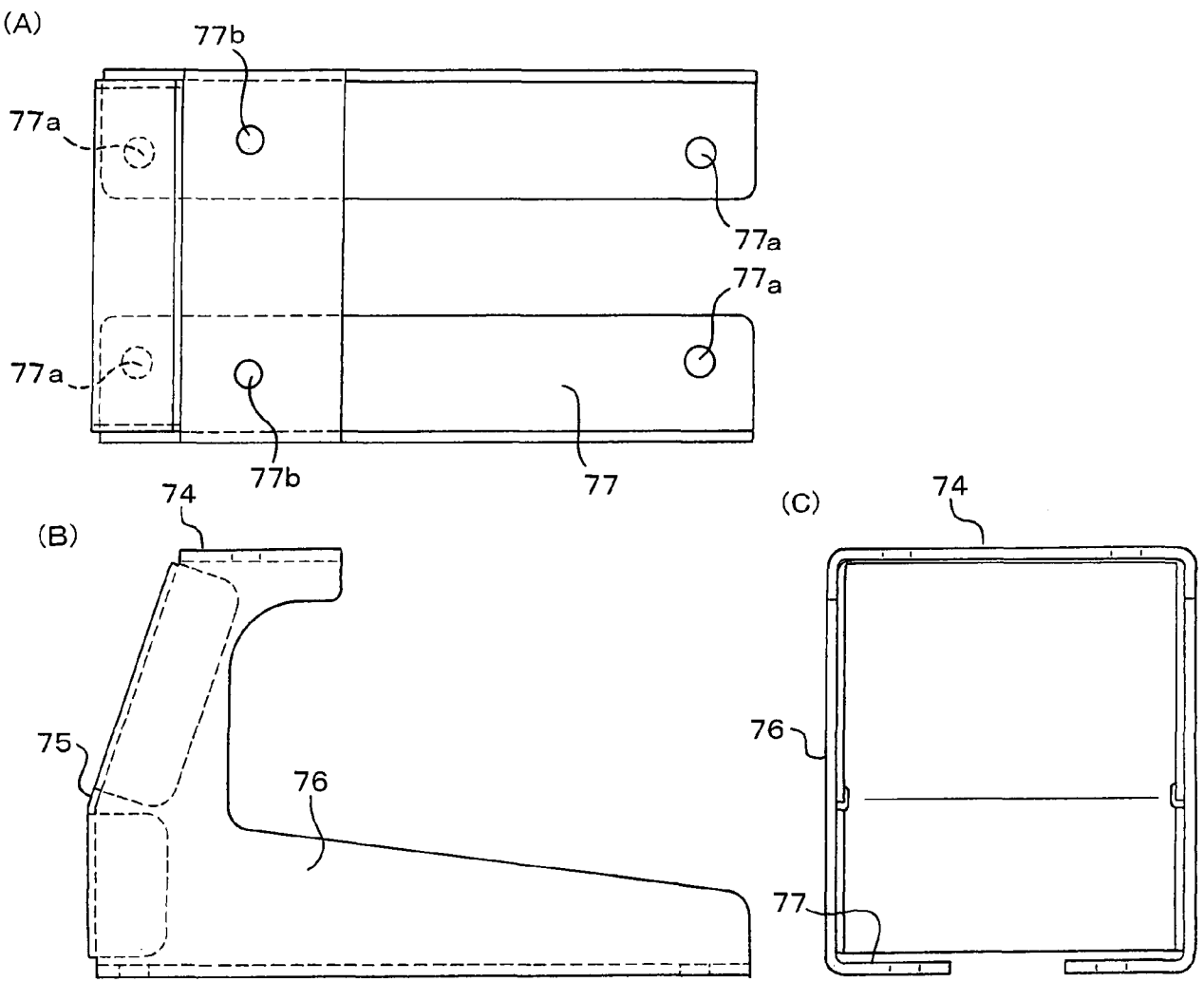
FIG. 19 shows a side view and a side view of the engagement groove.

FIG. 19 shows the structure of the engagement groove section 19 attached to the front portion of the stretcher. The front portion of the engagement groove section 19 is covered with a cover to prevent a finger from being nipped between the engagement groove 72 and the engagement portion 73 or to prevent dust from coming thereinto. As shown in FIG. 19-A, in the bottom face of the cover 71, four screw holes 77*a* are formed for securing the cover 71 to the center rail 14 of the stretcher. The screw holes 77*b* are screw holes for attaching the engagement groove 72 to the inside of the cover upper surface 74. As shown in FIG. 19-B, the side face 76 of the cover 71 has an L-like shape and has a structure, which receives an impact of the litter from the rear side. FIG. 5-C shows the configuration of the engagement groove section 19 viewed from the rear side. The engagement groove section 19 has a substantially square shape in section.

Figure 20:
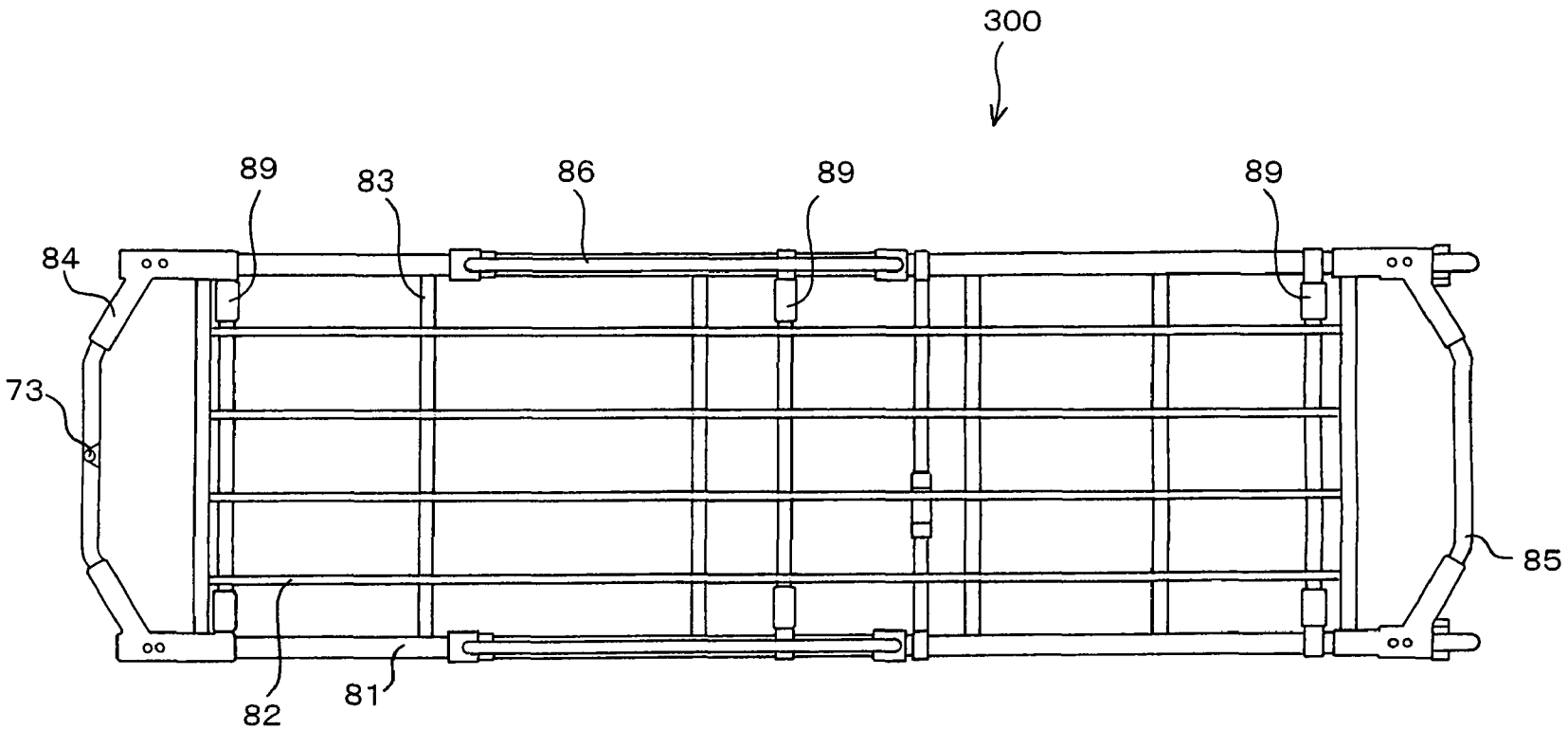
FIG. 20 is a top view of the litter having an engagement portion.

FIG. 20 is a top view of the litter 300 having an engagement portion 73 to be loaded on the stretcher having the engagement groove in accordance with the present invention. The frame of the litter 300 is structured including two outer frames 81 and a front-section frame 84 and a rear-section frame 85 attached at the both sides; and inside thereof, four inner frames 82 and six side frames 83 supporting them. Guide rollers 89 are provided so as to slide smoothly on the stretcher. At the head side of the litter, the engagement portion 73 for engaging with the engagement groove 72 of the stretcher for receiving the litter, which approaches sliding on the upper frame of the stretcher by means of the guide rollers 89, is provided.

Figure 21:
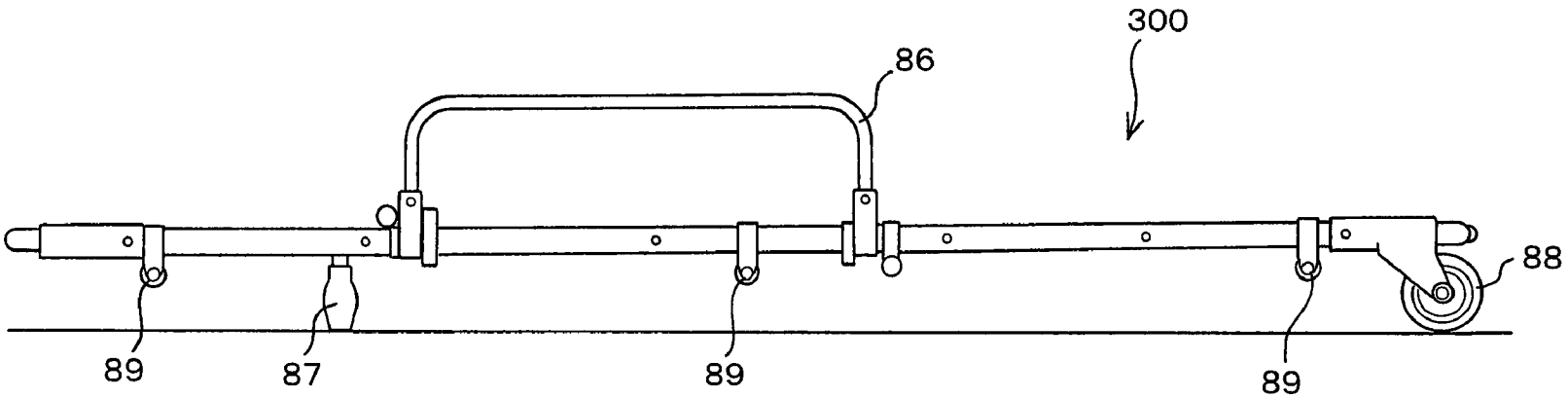
FIG. 21 is a side view of the litter.
Figure 22:
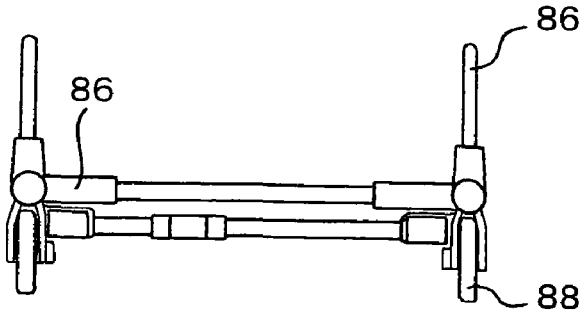
FIG. 22 is a top view of the guide roller.

FIG. 21 is a side view of the litter 300. In the upper portion of the litter, auxiliary frames 86 are pivoted so as to open/close outward. Posts 87 and castors 88 support the litter on a floor. When the litter is raised to carry using the castors 88, the posts 87 serve as grips; and when the litter is placed on the floor, the posts 87 serve as legs. When the litter is loaded on the stretcher, the posts 87 and the castors 88 function to sandwich the upper frame of the stretcher from both sides to prevent the litter from displacing sidewise. In the lower side of the frame of the litter, guide rollers 89 are provided so that the litter slides smoothly on the stretcher. In the side faces of the litter, the auxiliary frames 86 are provided for preventing a patient from falling off, or serving as auxiliary frames when the litter is lifted up. FIG. 22 shows the litter viewed from the leg side. In the lower portion of the litter, the castors 88 for supporting the litter are provided; and in the upper portion thereof, the auxiliary frames 86 are provided. The auxiliary frames 86 serve to prevent a patient from falling off, and serve as auxiliary frames to be gripped when the litter is lifted up from the side face of the litter.

The posts and the castors of the litter are arranged so as to position at the side outer than the position of the upper frame of the stretcher; thereby the grips and the castors of the litter sandwich the upper frame of the stretcher. Accordingly, the litter can be prevented from being displaced from the base of the stretcher due to the vibration while the stretcher is carried. Thus, the litter can be held stably on the base of the stretcher.

Figure 23:
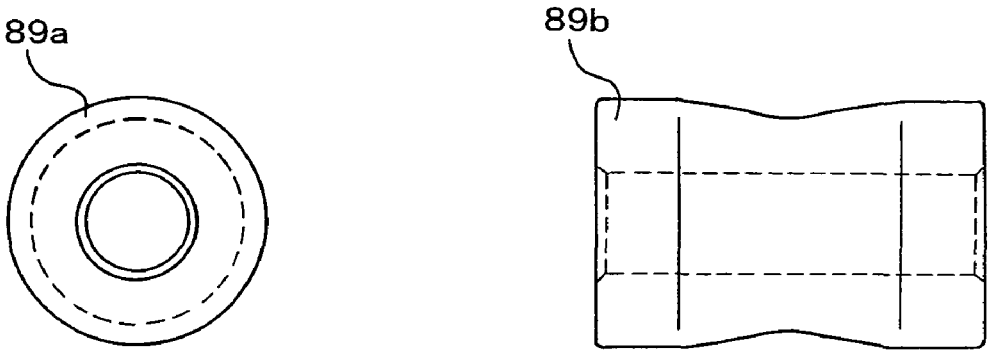
FIG. 23 is a front view of the litter.

As indicated with reference numeral 89*a* in FIG. 23, guide rollers 89 attached to the litter are ordinary rollers having a circular side face. However, as indicated with reference numeral 89*b*, the surface, which comes into contact with the upper frame of the stretcher, is concave toward its central area. Owing to this, even when the litter is placed on the upper frame of the stretcher with a small displacement with respect to the upper frame of the stretcher, the guide rollers 89 are pulled to the center of the upper frame of the stretcher along the slope of the guide rollers 89*b* and stabilized thereon. In the present invention, three guide rollers 89 are provided to one side; accordingly total six guide rollers 89 are provided to both sides. However the number of the guide rollers is not limited to six. Four guide rollers may be provided to one side; accordingly eight guide rollers may be provided to both sides. As for the material of the guide rollers, a synthetic resin, which has a little flexibility and emits smaller vibration and noise, is preferred to metal.

Figure 24:
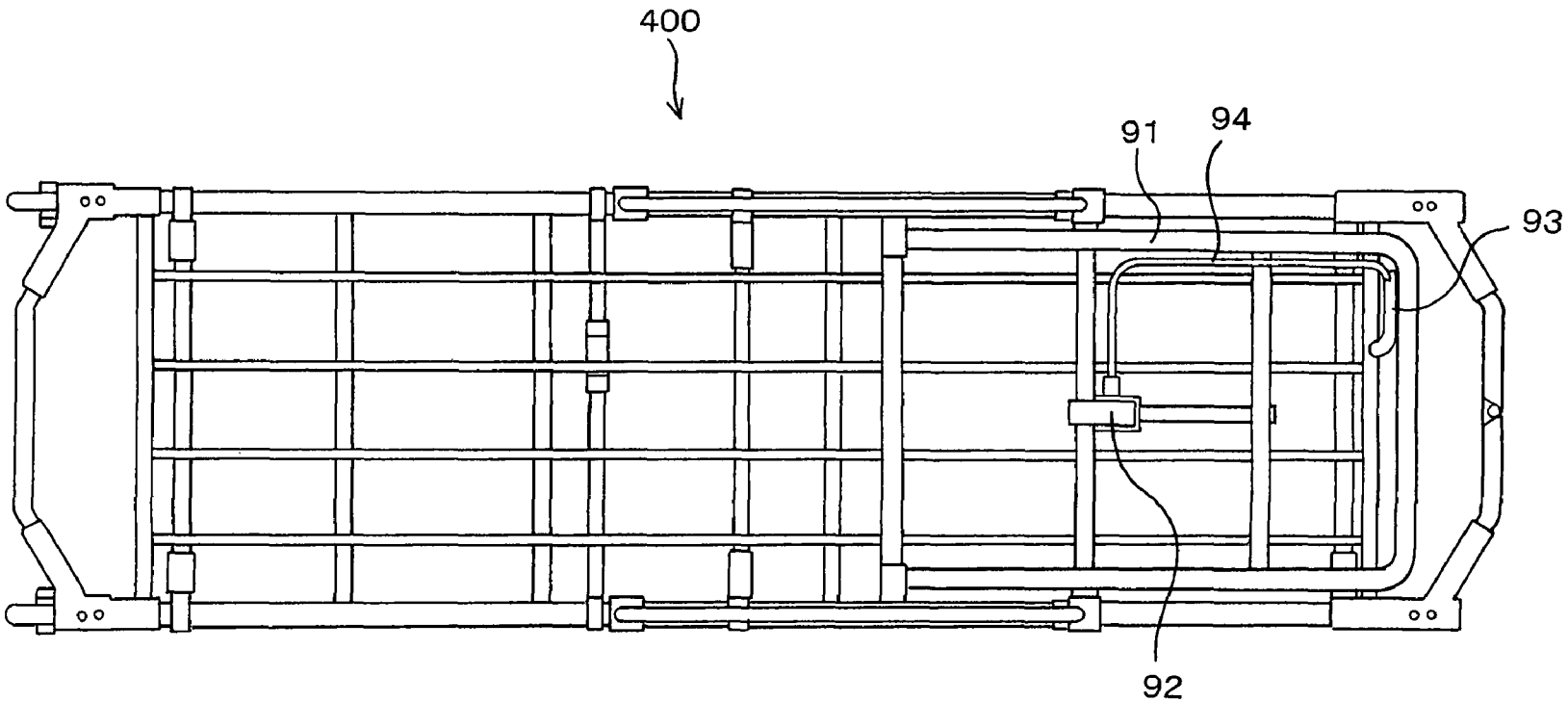
FIG. 24 shows a top view of a litter with a backrest.

FIG. 24 shows a litter 400 of a type in which a backrest 91 is provided in a portion of the litter where the back of a patient is positioned. The backrest type litter 400 is arranged so that one end of the backrest frame 91 is pivoted rotatably and the other end thereof is rotatable in the vertical direction. By operating a lever 93 provided to the upper portion of the backrest frame 91, the backrest can be raised. The lever 93 is connected to a pin-lock 92 via a wire 94. When the lever 93 is pulled, the pin-lock 92 is unlocked. And when the lever 93 is released at an appropriate height, the pin engages at an arbitrary height and the backrest frame 91 is secured.

Figure 25:
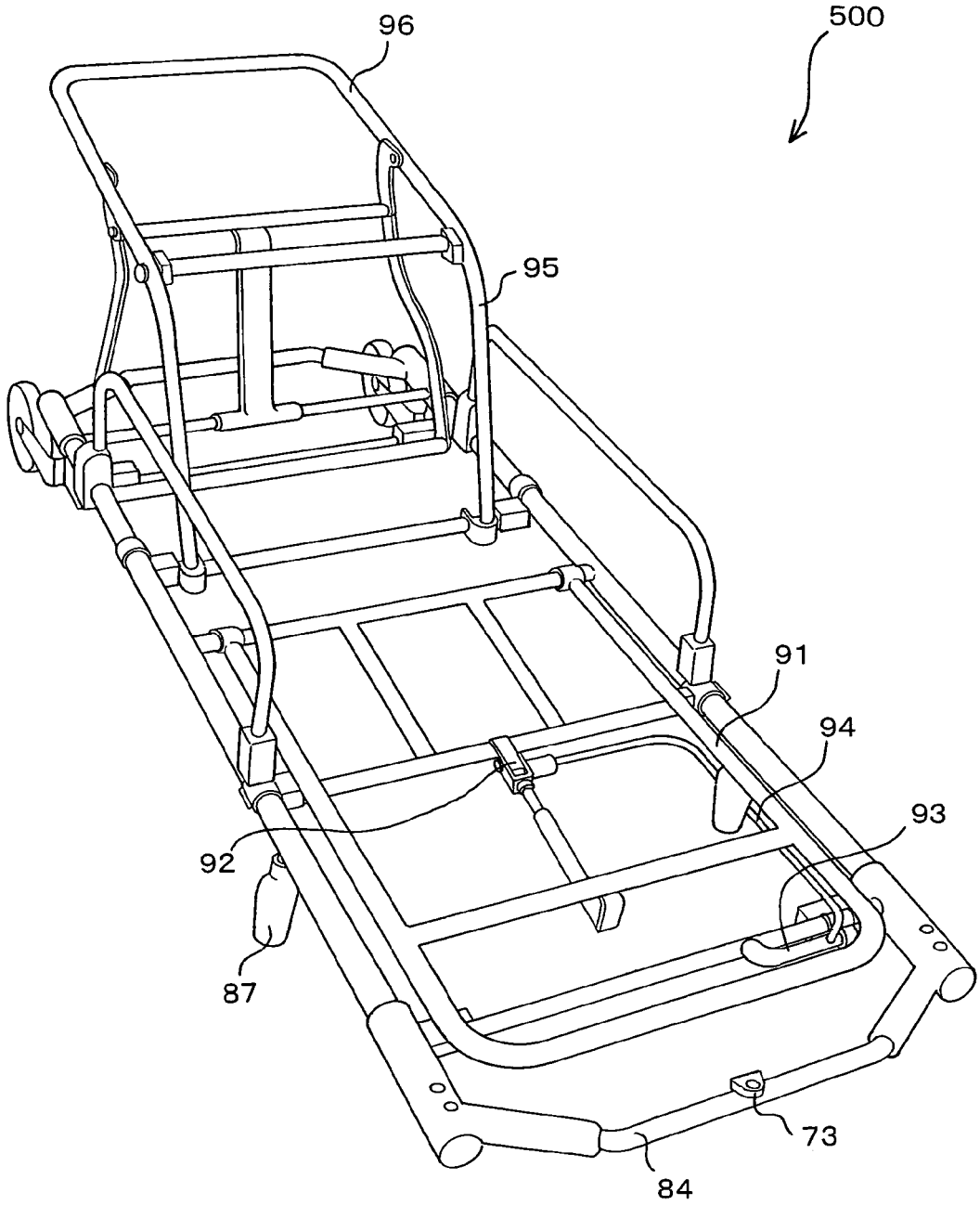
FIG. 25 is a perspective view of a chair type litter.

FIG. 25 shows a litter 500, which is another type litter to be loaded on the stretcher 200 of the present invention, which is capable of being changed into chair type. The litter 500 is arranged so that a backrest frame 91 is pivoted rotatably in the upper portion, and the backrest frame 91 can be raised with respect to the litter by operating a pin-lock 92 and an operation lever 93 provided in the backside of the backrest frame 91. In the seat frame 94 attached to the lower half of the litter, a front leg portion 95 and a front-leg auxiliary frame 96 are pivoted rotatably to the litter. When an emergency patient has to be carried in a narrow space, by changing the litter to chair-like configuration, an emergency patient can be carried in a state being sat thereon by one ambulance member. Needles to say, when the chair portion is folded, the litter can be used as a flat litter.

On the litters 300, 400 and 500 to be loaded on the stretcher, a sheet member stitched with cushion material is placed. Also, in appropriate portions of the frame such as points where body or feet of patient are positioned, belts for securing the patient are appropriately provided. In a point of the backrest frame 91 of the litter 400 or 500 having the backrest with which the back of the patient comes into contact, a solid plate such as aluminum plate or steel plate is attached so that artificial respiration or the like can be carried out. Further, in an upper portion of the backrest frame, a headrest capable of adjusting its angle may be provided.

Figure 26:
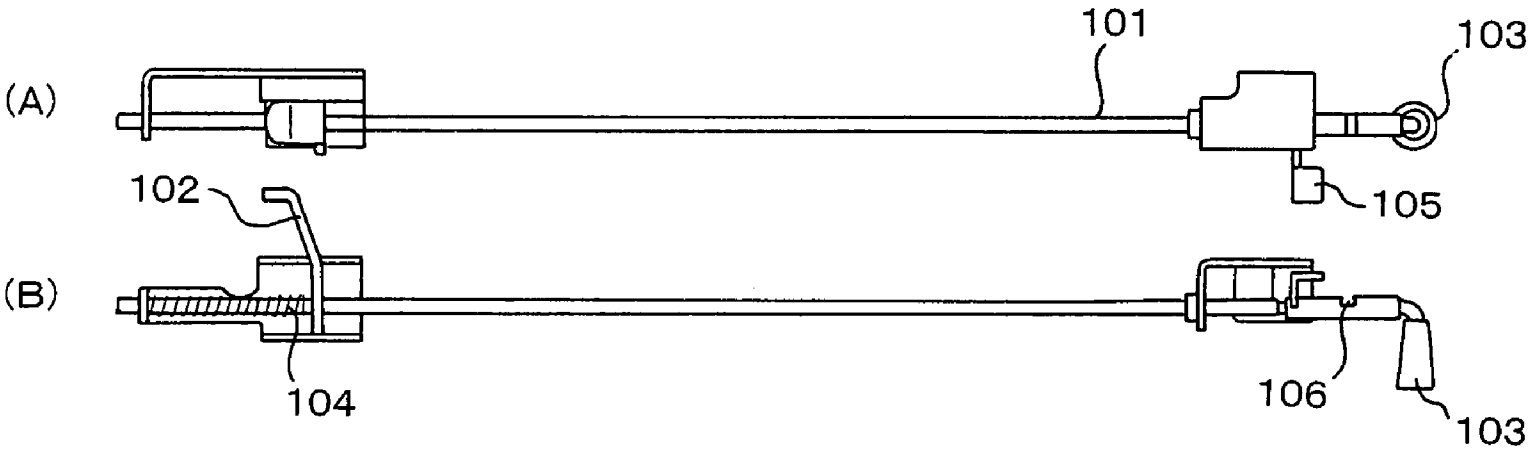
FIG. 26 is a top view of the stopper for loading and engaging with the litter of the stretcher.
Figure 27:
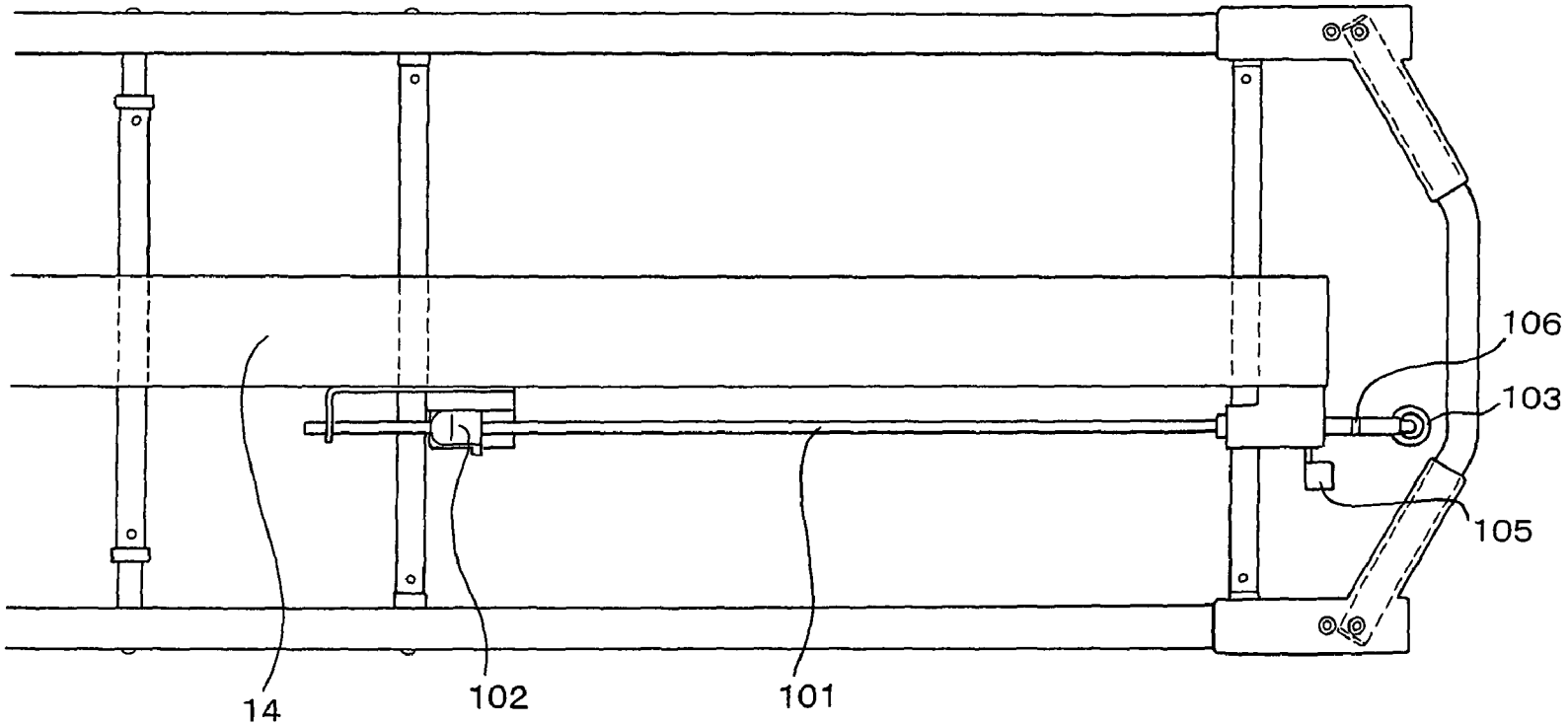
FIG. 27 is a top view of the stopper for loading and engaging with the litter of the stretcher.
Figure 28:
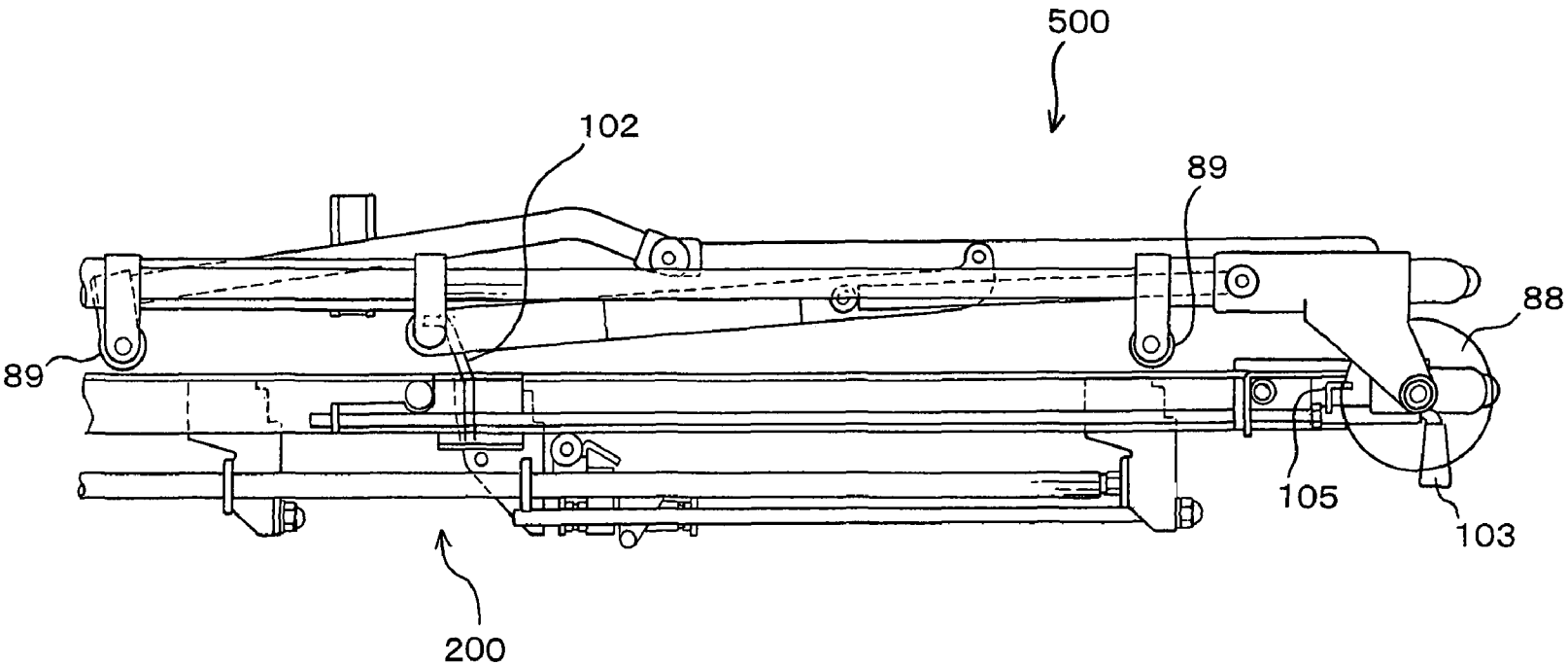
FIG. 28 is a side view of a portion in which the litter is loaded on the stretcher.

As the method for securing the leg side of the litter after loading the litter on the stretcher, a stopper having a hook of a J-like shape with energized spring shown in FIG. 26 is employed. FIG. 26A is a top view of a stopper 101 for litter; FIG. 26B is a side view thereof. The stopper 101 for litter includes a hook 102 having an energized spring 104, an operation lever 103 and a spring stopper 105 with an energized spring for securing the hook against the returning thereof. As shown in FIG. 27, the stopper 101 of the litter is attached to the side portion of the center rail 14 near the grip of the rear-end portion of the stretcher. FIG. 28 shows a state that the litter is attached to the stretcher. By operating the operation lever 103 shown in FIG. 28, the hook 102 is raised, and in a state that the side frame in the central area of the litter is pressed forward, the litter is stably secured on the stretcher. The spring stopper 105 with energized spring shown in FIG. 27 engages with the spring stopper groove 106; thus, the spring stopper 105 is prevented from being disengaged. As a result, as shown in FIG. 28, the hook 102 engages with the side frame of the litter and the stopper 101 strongly secures the litter on the stretcher.

INDUSTRIAL APPLICABILITY

The stretcher, which is capable of adjusting the height without giving patient any pain due to vibration or the like during transportation, is provided. The stretcher can be always loaded on an ambulance car to be ready for emergency act. The litter to be loaded on the stretcher can be carried to a various emergency sites to carry an emergency patient to an ambulance car.

The invention claimed is:

1. A stretcher, comprising:

an upper frame for loading a litter on its support portion having castors on its front-legs and rear-legs, the frame including a front-leg auxiliary frame supporter slidably engaged with front-leg auxiliary frame sliding pipes, a front-leg supporter slidably engaged with front leg sliding pipes, and a rear-leg auxiliary frame supporter slidably engaged with rear-leg auxiliary frame sliding pipes;

a constant force spring in a slide mechanism for vertically changing the position of the upper frame;

a front-leg assembly including a front-leg frame and a front-leg auxiliary frame;

a rear-leg assembly including a rear-leg frame and a rear-leg auxiliary frame;

a first mechanical locking device coupled to the front-leg auxiliary frame supporter for controlling the movement thereof;

a second mechanical locking device coupled to the front-leg supporter for controlling the movement thereof;

a third mechanical locking device coupled to the rear-leg auxiliary frame supporter for controlling the movement thereof; and first and second levers cooperatively releasing the first, second and third mechanical locking devices wherein the first lever is coupled to the second mechanical locking device and the second lever is coupled to both the third mechanical locking device and a releasable pin of the first mechanical locking device;

wherein each of the first second and third mechanical locking devices engage a guide pipe define insertion openings therethrough for slidingly receiving respective sliding pipes, and include at least one roller in rolling contact with a center rail of the stretcher.

2. The stretcher according to claim 1, wherein the front-leg auxiliary frame is provided with an auxiliary castor positioned along its length for facilitating the loading of the stretcher onto a stretcher base on an ambulance car.

3. A stretcher, comprising:

an upper frame for loading a litter on its upper portion having castors on its front-legs and rear-legs, the upper frame including a plurality of inner frame bridges inside the upper frame and attached to a center rail, front-leg auxiliary frame sliding pipes attached to the center rail, front leg sliding pipes attached to the center rail, and rear-leg auxiliary frame sliding pipes attached to the center rail, the frame further including a front-leg auxiliary frame supporter, a front-leg supporter and a rear-leg auxiliary frame supporter;

a front-leg assembly including a front-leg frame and a front-leg auxiliary frame;

a rear-leg assembly including a rear-leg frame and a rear-leg auxiliary frame;

a constant force spring in a slide mechanism for vertically changing the position of the upper frame;

a first mechanical locking device coupled to the front-leg auxiliary frame supporter for controlling the movement thereof;

a second mechanical locking device coupled to the front-leg supporter for controlling the movement thereof;

a third mechanical locking device coupled to the rear-leg auxiliary frame supporter for controlling the movement thereof;

first and second levers positioned at opposing ends of the stretcher, the first lever coupled to the second mechanical locking device and the second lever coupled to the third mechanical locking device and a releasable pin of the first mechanical locking device;

wherein each of the first second and third mechanical lockin devices engage a guide pipe, define insertion openings therethrough for slidingly receiving respective sliding pipes, and include at least one roller in rolling contact with a center rail of the stretcher.

4. The stretcher according to claim 3, wherein the front-leg auxiliary frame is provided with an auxiliary castor positioned along its length for facilitating the loading of the stretcher onto a stretcher base on an ambulance car.

5. The stretcher according to claim 3, further comprising an engagement groove for securing a mounted litter to the stretcher, the engagement groove defining a trapezoid concave shape having sloped side surfaces for correcting litter displacement with respect to the stretcher upon loading the litter onto the stretcher.

6. The stretcher according to claim 3, further comprising a stopper for fixing a leg side of a litter to the stretcher.

7. The stretcher according to claim 3, wherein the upper frame engages with a plurality of guide rollers of the litter.

8. A stretcher, comprising:

a frame for supporting a litter, the frame including a front-leg auxiliary frame supporter slidably engaged with front-leg auxiliary frame sliding pipes, a front-leg supporter slidably engaged with front leg sliding pipes, and a rear-leg auxiliary frame supporter slidably engaged with rear-leg auxiliary frame sliding pipes;

a front-leg assembly including a front-leg frame and a front-leg auxiliary frame;

a rear-leg assembly including a rear-leg frame and a rear-leg auxiliary frame a first mechanical locking device coupled to the front-leg auxiliary frame supporter for controlling the movement thereof;

a second mechanical locking device coupled to the front-leg supporter for controlling the movement thereof;

a third mechanical locking device coupled to the rear-leg auxiliary frame supporter for controlling the movement thereof;

first and second levers associated with the mechanical locking devices for vertically adjusting the height of the stretcher, the first lever operable for unlocking the mechanical locking devices and the second lever operable for engaging/disengaging a pin of a lock mechanism of a front-leg auxiliary frame as well as unlocking the mechanical locking devices;

wherein each of the first second and third mechanical lockin devices engage a guide pipe, define insertion openings therethrough for slidingly receiving respective sliding pipes, and include at least one roller in rolling contact with a center rail of the stretcher.

9. The stretcher according to claim 8, further comprising at least one castor carried on the front-leg auxiliary frame for facilitating stretcher loading onto an ambulance.

10. The stretcher according to claim 8, further comprising an engagement groove for securing a mounted litter to the stretcher, the engagement groove defining a trapezoid concave shape having sloped side surfaces for correcting litter displacement with respect to the stretcher upon loading the litter onto the stretcher.

11. The stretcher according to claim 8, further comprising a stopper for fixing a leg side of a litter to the stretcher.

12. The stretcher according to claim 8, further comprising a constant force spring in a slide mechanism for steplessly vertically changing the position of the frame.

* * * * *